US009381559B2

(12) United States Patent
Matsumura

(10) Patent No.: US 9,381,559 B2
(45) Date of Patent: Jul. 5, 2016

(54) PUNCH OF PUNCHING PRESS, NIBBLER ASSEMBLY, AND METHOD OF FORMING ELONGATED HOLE IN SHEET MATERIAL

(75) Inventor: Kohei Matsumura, Inuyama (JP)
(73) Assignee: MURATA MACHINERY, LTD., Kyoto (JP)

( * ) Notice: Subject to any disclaimer, the term of this patent is extended or adjusted under 35 U.S.C. 154(b) by 232 days.
(21) Appl. No.: 13/997,362
(22) PCT Filed: Nov. 16, 2011
(86) PCT No.: PCT/JP2011/076379
§ 371 (c)(1), (2), (4) Date: Jun. 24, 2013
(87) PCT Pub. No.: WO2012/093523
PCT Pub. Date: Jul. 12, 2012
(65) Prior Publication Data
US 2013/0276603 A1 Oct. 24, 2013
(30) Foreign Application Priority Data
Jan. 7, 2011 (JP) ..... 2011-002172
(51) Int. Cl.
*B21D 28/10* (2006.01)
*B21D 28/02* (2006.01)
*B21D 28/16* (2006.01)
(52) U.S. Cl.
CPC ..... *B21D 28/02* (2013.01); *B21D 28/10* (2013.01); *B21D 28/16* (2013.01); *Y10T 83/0524* (2015.04); *Y10T 83/9418* (2015.04)
(58) Field of Classification Search
CPC ..... B21D 28/34; B21D 28/02; B21D 28/10; B21D 28/14
USPC ..... 83/685, 686, 49, 916
See application file for complete search history.

(56) References Cited

U.S. PATENT DOCUMENTS 1,870,356 A * 8/1932 Davis et al. ..... 128/100.1
2,064,796 A * 12/1936 Gray ..... 83/395
4,545,272 A * 10/1985 Herb ..... 83/395
5,170,560 A * 12/1992 Allemann et al. ..... 30/228
5,499,566 A 3/1996 Endo et al.

(Continued)

FOREIGN PATENT DOCUMENTS

CN 201380235 Y 1/2010
JP 62-96928 U 6/1987

(Continued)

OTHER PUBLICATIONS

English translation of Official Communication issued in corresponding International Application PCT/JP2011/076379, mailed on Jul. 18, 2013.

(Continued)

*Primary Examiner* — Stephen Choi
*Assistant Examiner* — Fernando Ayala
(74) *Attorney, Agent, or Firm* — Keating & Bennett, LLP

(57) ABSTRACT

A punch includes first and second blade sections juxtaposed relative to each other in a direction parallel or substantially parallel to a feed direction of a sheet material. The first blade section protrudes downwardly from the second blade section with a step intervening therebetween and includes lower end edges on downstream and upstream sides of the feed direction, which define respective punching edges. The first blade section includes a lower end edge following the feed direction, which defines a first notching and punching edge. The notching and punching edge includes a portion intermediate of the feed direction representing a projecting shape. The second blade section includes a lower end edge on the upstream side, which defines a punching edge and also includes a lower end edge following the feed direction, which defines a notching and punching edge. The notching and punching edge is inclined gradually upwardly towards the upstream side.

3 Claims, 21 Drawing Sheets

(56) References Cited

U.S. PATENT DOCUMENTS

| | | | | |
|---|---|---|---|---|
| 5,682,782 | A * | 11/1997 | Rosene et al. | 72/179 |
| 5,988,032 | A * | 11/1999 | Seki | 83/583 |
| 6,209,434 | B1 * | 4/2001 | Kim et al. | 83/549 |
| 7,210,384 | B2 * | 5/2007 | Elynuik | 83/166 |
| 7,950,261 | B2 * | 5/2011 | Sasaki et al. | 72/348 |
| 2007/0044623 | A1 * | 3/2007 | Marks | 83/686 |
| 2009/0223275 | A1 * | 9/2009 | Hanna | 72/470 |
| 2010/0242565 | A1 * | 9/2010 | Flehmig et al. | 72/352 |
| 2012/0073350 | A1 * | 3/2012 | Iwata et al. | 72/347 |

FOREIGN PATENT DOCUMENTS

| | | | |
|---|---|---|---|
| JP | 3-9865 | Y2 | 3/1991 |
| JP | 07-51766 | A | 2/1995 |
| JP | 2000-351024 | A | 12/2000 |
| JP | 2003-230920 | A | 8/2003 |
| JP | 3960066 | B2 | 5/2007 |

OTHER PUBLICATIONS

Official Communication issued in International Patent Application No. PCT/JP2011/076379, mailed on Jan. 24, 2012.

Official Communication issued in corresponding Chinese Patent Application No. 201180060963.5, mailed on Jun. 30, 2014.

Pei, W., "Practical Stamping Technical Manuals", Machinery Industry Press, Jun. 30, 2001, pp. 31-32.

* cited by examiner 1
2
3
4
4a
4c
5
11
14
15
33
W
A 1
2
3
4
5
W
11
14
15
33
A 1
2
3
4
5
5a
5c
11
14
15
33
34
35
36
W
A 1
2
3
4
5
5a
11
14
15
31
35
36
W
A 1
2
3
4
4a
4c
5
W
14
15
33
41
A 1
2
3
4
5
W
33
14
15
41
A 1
2
3
4
4a
5
5a
5c
W
14
15
33
34
35
36
41
42
A 1
2
3
4
5
5a
5c
14
15
34
35
36
41
W
A 1
2
3
4
5
5a
W
35
36
43
51
14
15
41
A

PRIOR ART

PUNCH OF PUNCHING PRESS, NIBBLER ASSEMBLY, AND METHOD OF FORMING ELONGATED HOLE IN SHEET MATERIAL

CROSS REFERENCE TO THE RELATED APPLICATION

This application is based on and claims convention priority to Japanese patent application No. 2011-002172, filed Jan. 7, 2011, the entire disclosure of which is herein incorporated by reference as a part of this application.

BACKGROUND OF THE INVENTION

1. Field of the Invention

The present invention relates to a punch for a punching press to perform a nibbling operation on a sheet material, a nibbler assembly and a method of forming an elongated hole in the sheet material.

2. Description of Related Art

To nibble a sheet material with the use of a punching press, a method of continuously processing a number of punched holes has been well known, in which the die is a punching die of a type having a rectangular transverse sectional shape. According to this known method, a problem arises such that ends of overlap areas of holes which are continuously punched are such that, as shown in FIGS. 20A and 20B, an upper portion of a punched surface 100 of a sheet material W tends to have a projection-shaped seam 102 with no roll-over 101 formed. It is to be noted that, as shown in FIG. 20C, the punched surface 100 formed by a punching process represents a roll-over 101, a sheared surface 103 and a fractured surface 104 in this order with respect to the side in which a punch is advanced.

As a punch processing method effective to eliminate the above described seam 102, a method has been suggested (in, for example, Japanese Patent No. 3960066) in which with the use of a nibbler assembly having a cutting blade section that includes a bottom surface inclined relative to the level surface, the sheet material is not punched out but is cut at the cutting blade section and the subsequent cutting is continued from the previous cutting. According to such processing method in which the cuttings are successively applied, punched surfaces can be continuously finished beautifully. The nibbler assembly employed in the practice of the above described suggested method has a punching blade section separate from the cutting blade section and, by means of this punching blade section, an inner side portion of the cutting formed by the cutting blade section during the previous punching process is punched out.

To use the above described conventional nibbler assembly, an access opening needs to be formed in the sheet material beforehand, which access opening is necessitated to enable a blade portion of the punch to be inserted therethrough when a cutting is worked on the sheet material at the initial process of nibbling. For this reason, at the end of the overlap area between the access opening and the initial cutting, a projection-shaped seam 102 (best shown in FIGS. 20A and 20B) is inevitably left therein.

Also, the above described conventional nibbler assembly is, in the final step of nibbling, incapable of punching off an inner side portion of the cutting, formed during the previous punching process, with a portion left uncut. That is because the inner side portion of the cutting is downwardly bent and, therefore, such a bent inner side portion interferes with a die. For example, in an inner periphery processing such as a processing of a corner portion of, for example, a window hole, when the corner portion is to be punched out with the use of the standard punch, unless a portion of the cutting is left in a final portion of an elongated hole formed by nibbling, a projection-shaped seam 102 (best shown in FIGS. 20A and 20B) tends to be left in one end of an overlap area between the elongated hole, formed by nibbling, and a punched hole formed by the standard punch in a manner similar to that described hereinbefore.

SUMMARY OF THE INVENTION

Preferred embodiments of the present invention provide a punch for a punching press, which is capable of accomplishing a processing without leaving a seam at a starting end portion of the punching process and ends of overlap areas of nibbling in the event that sheet material is nibbled by the punching press, a nibbler assembly including the punch and a die, and a method of forming an elongated hole with the use of the nibbler assembly.

According to a preferred embodiment of the present invention, a punch for a punching press capable of performing a nibbling operation on a sheet material includes a first blade section and a second blade section juxtaposed relative to each other in a direction parallel or substantially parallel to a feed direction of the sheet material and including respective side surfaces lying along the feed direction of the sheet material, the respective side surfaces of the first and second blade section being positioned on the same plane. The first blade section protrudes downwardly from the second blade section with a step intervening therebetween, includes lower end edges on downstream and upstream side with respect to the feed direction of the sheet material, which define a punching edge, and also includes a lower end edge parallel or substantially parallel to the feed direction of the sheet material, which defines a notching and punching edge, and the notching and punching edge including a portion intermediate of the feed direction of the sheet material that protrudes downwardly. The second blade section includes a lower end edge on an upstream side with respect to the feed direction of the sheet material, which defines a punching edge and also includes a lower end edge parallel or substantially parallel to the feed direction of the sheet material, which defines a notching and punching edge, the notching and punching edge is of a shape inclined gradually upwardly towards the upstream side with respect to the feed direction of the sheet material.

The punch according to a preferred embodiment of the present invention described above is preferably used in combination with a die. In other words, the punching process is carried out by placing the sheet material above the die horizontally and then driving the punch downwardly to press the sheet material. By properly setting the height through which the punch is driven downwardly, a process of forming the notch in the sheet material with the notching and punching edge of the first blade section or the notching and punching edge of the second blade section so as to extend in a direction parallel or substantially parallel to the feed direction of the sheet material and a punching process of punching the sheet material with the first blade section can be accomplished.

By way of example, when the nibbling is carried out, the punching process of forming the punched hole by punching the inner side portion of the notch with the first blade section while the base end portion of the previously formed notch is left to remain and of forming the notch following the punched hole with the notching and punching edge of the second blade section is repeated a number of times while the relative position of the punch and the sheet material is displaced in a direction parallel or substantially parallel to the feed direction of the sheet material. By this nibbling, the sheet material is cut with the notches of the punching process overlapping one above the other. Also, with the punched holes of the punching process overlapping, the elongated hole is formed so as to extend in a direction parallel or substantially parallel to the feed direction of the sheet material. In performing the above described nibbling, since the sheet material portion positioned inwardly of the notch is punched by the first blade section, no seam such as that occurring when the individual punched holes are continuously formed occurs at the ends of overlapping portions of the punched holes.

Since the notching and punching edge of the first blade section is shaped so as to have a portion thereof intermediate of the feed direction of the sheet material which protrudes downwardly, both of the notches extending respectively towards the downstream and upstream sides with respect to the feed direction of the sheet material can also be formed. For this reason, where the cutting of the sheet material is performed and the elongated hole in the sheet material are formed by the nibbling, it is possible to avoid formation of seams at opposite ends of the cutting line and the elongated hole.

According to another preferred embodiment of the present invention, a nibbler assembly for the first punching press includes the punch according to a preferred embodiment of the present invention and a die. The die referred to above is partitioned by a partition wall into the downstream and upstream sides with respect to the feed direction of the sheet material, and includes first and second throughholes defined on the downstream and upstream sides, respectively, the first and second blade sections of the punch entering the first and second throughholes, respectively. The first throughhole referred to above is such that, of the inner wall surfaces defining the first throughhole, wall surface portions on the downstream and upstream side with respect to the feed direction of the sheet material define die side punching edges engageable with the punching edge on the downstream and upstream side of the first blade section and that an upper end edge of a wall surface portion following the feed direction of the sheet material defines a die side notching and punching edge engageable with the notching and punching edge of the first blade section. The second throughhole referred to above is such that, of the inner wall surfaces forming the second throughhole, an upper end edge of a wall surface portion on the upstream side with respect to the feed direction of the sheet material defines a die side punching edge engageable with the punching edge of the second blade section and that an upper end edge of a wall surface portion parallel or substantially parallel to the feed direction of the sheet material defines a die side notching and punching edge engageable with the notching and punching edge of the second blade section.

The nibbler assembly of the structure described above is such that the punching process is carried out by placing the sheet material horizontally on the die and then driving the punch downwardly against the sheet material. By properly setting the relative position between the sheet material and the nibbler assembly in a direction parallel or substantially parallel to the feed direction of the sheet material and the height through which the punch is driven, the following steps can be worked on the sheet material.

When the punch is downwardly stricken so that only the notching and punching edge of the first blade section may assume a heightwise level not exceeding an upper surface of the sheet material, a process takes place in which a portion of the sheet material positioned below the first blade section is depressed downwardly by the first blade section so as to render such portion to be a depressed piece that is notched in a direction parallel or substantially parallel to the feed direction of the sheet material. Since the notching and punching edge of the first blade section is of a shape so as to have the intermediate portion of the feed direction of the sheet material protruding downwardly, the depressed piece referred to above is of a shape such that the intermediate portion of the feed direction of the sheet material is most deformed downwardly with opposite ends with respect to the feed direction of the sheet material being connected with a main body portion of the sheet material.

When the nibbler assembly is positioned so as to allow the position of the depressed piece with respect to the feed direction of the sheet material to straddle between the first blade section and the second blade section and then the punch thereof is downwardly stricken so that the whole or a portion of the notching and punching edge of the second blade section may assume a heightwise level not exceeding the upper surface of the sheet material and, at the same time, the punching edge of the second blade section may assume a heightwise level above the upper surface of the sheet material, a process takes place in which the punched hole is formed by punching the depressed piece and a sheet material portion on the downward side thereof with respect to the feed direction of the sheet material with the first blade section and, also, the notch following the punched hole is formed by the second blade section so as to extend towards the upstream side with respect to the feed direction of the sheet material so as to depress the inner side portion of such notch downwardly to form the notched piece.

Since the depressed piece is such that only the notch extending in the direction parallel or substantially parallel to the feed direction of the sheet material is merely formed and no processed hardening occurs in the vicinity of a base end of the notch, even though a sheet material portion including the depressed piece is punched off by the first blade section, no seam such as that occurring when the individual punched holes are continuously formed is formed at ends of overlapping portions of the notch and the punched hole. The notched piece is of a shape including a tip end side deformed downwardly and is connected at its base end with the main body portion of the sheet material.

When the nibbler assembly is positioned so as to allow the position of the depressed piece with respect to the feed direction of the sheet material to straddle between the first blade section and the second blade section and then the punch thereof is downwardly stricken so that the whole or a portion of the notching and punching edge of the second blade section may assume a heightwise level not exceeding the upper surface of the sheet material and, at the same time, the punching edge of the second blade section may assume a heightwise level above the upper surface of the sheet material, a process takes place in which the punched hole is formed by punching the depressed piece and a sheet material portion on the downward side thereof with respect to the feed direction of the sheet material with the first blade section and, also, the notch following the punched hole is formed by the second blade section so as to extend towards the upstream side with respect to the feed direction of the sheet material so as to depress the inner side portion of such notch downwardly to form the notched piece.

Since the notched piece, too, is merely formed with a notch extending in a direction parallel or substantially parallel to the feed direction of the sheet material as is the case with the depressed piece and no processed hardening occurs in the vicinity of the base end of the notch, even though the sheet material portion including the depressed piece is punched by the first blade section, no seam is formed at ends of overlapping portions of the notch and the punched hole. If this processing is carried out repeatedly a number of times while the nibbler assembly is displaced relative to the sheet material in a direction parallel or substantially parallel to the feed direction of the sheet material, the punched holes formed by the repeated processing come to be overlapped with each other with the elongated hole consequently formed in a direction parallel or substantially parallel to the feed direction of the sheet material.

Here, the notched piece occupies a position, with respect to the feed direction of the sheet material, where the first blade section and the second blade section are straddled and, at the same time, the nibbler assembly is positioned so that the punching edge of the second blade section is held at a position immediately above a terminating end of the elongated hole desired to be formed in the sheet material. Then, the punch is driven downwards so as to allow notching edge of the second blade section to assume a heightwise level not exceeding the lower surface of the sheet material, a process takes place in which the punched hole is formed by punching the notched piece and the sheet material portion on the upstream side thereof with respect to the feed direction of the sheet material. As is the case with that described hereinbefore, no seam or substantially no seam is formed at the ends where the notch and the punched holes overlap with each other.

Yet another preferred embodiment of the present invention provides a method of forming an elongated hole in the sheet material via a punching press, which method includes a starting end notching step, a starting end punching step, a nibbling step and a terminating end punching step. The starting end notching step referred to above is a step of forming two parallel notches at a starting end of an elongated hole, desired to be formed in the sheet material, so as to extend in a direction parallel or substantially parallel to a feed direction of the sheet material, and then depressing a sheet material portion, bound between those two notches, downwardly to form a depressed piece. The starting end punching step referred to above is a step of punching the depressed piece and a sheet material portion on a downstream side thereof with respect to the feed direction of the sheet material to form a punched hole which is a starting end of the elongated hole, then forming two parallel notches following the punched hole so as to extend in a direction towards the upstream side with respect to the feed direction of the sheet material, and depressing a sheet material portion, bound between those two notches, downwardly to form a notched piece. The nibbling step referred to above is a step which is performed a number of times repeatedly subsequent to the starting end punching step and which is carried out by forming a punched hole by punching a notched piece, which has been formed during the starting end punching step or the previous nibbling step, to form a punched hole, forming two parallel notches subsequent to the punched hole so as to extend in a direction parallel or substantially parallel to the feed direction of the sheet material, and depressing a sheet material portion, bound between those two notches, downwardly to form a notched piece. The terminating end punching step referred to above is a step of punching the notched piece, which has been formed during the final nibbling step, to form a punched hole which defines a terminating end of the elongated hole.

The method of forming the elongated hole in the sheet material referred to above is practiced with the use of, for example, the above described nibbler assembly. In such a case, the various steps are as follows.

The starting end notching step referred to above includes positioning the nibbler assembly so as to align the position of the punching edge on the downstream side of the first blade section of the punch with a starting end of the elongated hole, which is to be formed in the sheet material, or so as to assume that portion on an upstream side of the starting end with respect to the feed direction of the sheet material. This step further includes driving the punch for the nibbler assembly downwardly so as to allow the only notching and punching edge of the first blade section to assume a heightwise level not exceeding the upper surface of the sheet material. By so doing, a portion of the sheet material, positioned below the first blade section, with the first blade section is depressed downwardly to render that portion to form a depressed piece having a notch extending in a direction parallel or substantially parallel to the feed direction of the sheet material. The depressed piece is most downwardly depressed at an intermediate portion of the feed direction of the sheet material with its opposite end in the feed direction of the sheet material remaining connected with the main body portion of the sheet material.

The starting end punching step referred to above includes positioning the nibbler assembly so as to allow the position of the depressed piece with respect to the feed direction of the sheet material to straddle between the first blade section and the second blade section and then downwardly driving the punch thereof so that the whole or a portion of the notching and punching edge of the second blade section may assume a heightwise level not exceeding the upper surface of the sheet material and, at the same time, the punching edge of the second blade section may assume a heightwise level above the upper surface of the sheet material. By so doing, the punched hole is formed by punching the depressed piece and a sheet material portion on the downward side of the depressed piece with respect to the feed direction of the sheet material with the first blade section and, also, the notch following the punched hole is formed by the second blade section so as to extend towards the upstream side of the punched hole so as to depress the inner side portion of such notch downwardly to form the notched piece.

Since the depressed piece referred to above is merely formed with the notch extending in the direction parallel or substantially parallel to the feed direction of the sheet material, even though the sheet material portion including the depressed piece is punched with the first blade section, no seam such as that occurring when the individual punched holes are continuously formed is formed at ends of overlapping portions of the notch and the punched hole. The notched piece is of a shape having a tip end side deformed downwardly and is connected at its base end with the main body portion of the sheet material.

The nibbling step is repeatedly performed a number of times following the starting end punching step. In the nibbling step, the nibbler assembly is positioned so as to allow the position of the notched piece with respect to the feed direction of the sheet material, which notched piece is formed during the starting end punching step or the previous nibbling step, to straddle between the first blade section and the second blade section. Then, the punch is driven downwardly so that the whole or a portion of the notching and punching edge of the second blade section may assume a heightwise level not exceeding the upper surface of the sheet material and, at the same time, the punching edge of the second blade section may assume a heightwise level above the upper surface of the sheet material. By so doing, the punched hole is formed by punching the notched piece with the first blade section to form a punched hole and, also, a new notch following the punched hole is formed with the second blade section so as to extend towards the upstream side of the punched hole with respect to the feed direction of the sheet material to depress the inner side portion of such notch downwardly to form the new notched piece.

Since even the notched piece referred to above is merely formed with the notch extending in the direction parallel or substantially parallel to the feed direction of the sheet material, no seam such as that occurring when the individual punched holes are continuously formed is formed at ends of overlapping portions of the notch and the punched hole as is the case with that described previously. The elongated hole extending in a direction parallel or substantially parallel to the feed direction of the sheet material is formed as a result of the punched holes being formed by the processing during the nibbling step that is performed a number of times repeatedly.

The terminating end punching step includes positioning the nibbler assembly so that the position of the notched piece, which has been formed during the final cycle of the nibbling step, with respect to the feed direction of the sheet material becomes the position at which it straddles between the first blade section and the second blade section and, at the same time, so that the position of the punching edge of the second blade section with respect to the feed direction of the sheet material aligns with a terminating end of the elongated hole that is to be formed in the sheet material. This step further includes driving the punch of the nibbler assembly downwardly to allow the punching edge of the second blade section to assume a heightwise level not exceeding an undersurface of the sheet material, so as to punch out the notched piece, formed during the final cycle of the nibbling step to form a punched hole, which defines the terminating end of the elongated hole. Even in this case, as is the case with that described previously, no seam or substantially no seam occurs at the ends where the punched hole and the notch are overlapped with each other.

In the nibbler assembly for the punching press according to a preferred embodiment of the present invention, it is preferred that in the first throughhole, a wall surface portion forming a die side punching edge engageable with the punching edge on the downstream side includes an upper end edge lower than a wall surface portion forming the die side notching and punching edge engageable with the notching and punching edge and a downstream side cutout, which includes an upper surface of a height lower than any other portion, is formed from the wall surface portion, including such a low upper end edge thereof, towards the downstream side. In such a case, in the second throughhole, a wall surface portion forming a die side punching edge engageable with the punching edge may include an upper end edge lower than a wall surface portion forming the die side notching and punching edge engageable with the notching and punching edge and an upstream side cutout and an upstream side cutout is formed, which includes an upper surface of a height lower than any other portion, is formed from the wall surface portion, including such a low upper end edge thereof, towards the downstream side.

In the construction described hereinabove, the nibbler assembly is positioned so that the punching edge on the downstream side of the first blade section of the punch may be positioned so as to assume a position immediately above the depressed piece. Then, the punch is driven downwardly so that the whole or a portion of the notching and punching edge of the second blade section thereof may assume a heightwise level not exceeding the upper surface of the sheet material, and, at the same time, the punching edge of the second blade section may assume a heightwise level exceeding the upper surface of the sheet material. By so doing, a portion of the depressed piece on the upstream side with respect to the feed direction of the sheet material and a sheet material portion on the upstream side of the depressed piece are punched by the first blade section to form a punched hole while the remaining portion of the depressed piece is left on the die and, also, a notch extending towards the upstream side of the punched hole is formed by the second blade section following the punched hole, with an inner side portion of such notch being depressed downwardly to form a notched piece.

As is the case with that described previously, no seam or substantially no seam is left at opposite ends of the portion where the notch of the depressed piece and the punched hole overlap with each other. Thus, by allowing a portion of the depressed piece left remaining, it is possible to allow the seam not to be left remaining when the remaining depressed piece and the sheet material portion on the downstream side of the depressed piece are subsequently punched. The notched piece is of a downwardly deformed towards a tip end side and remains connected at its base end with the main body portion of the sheet material.

By positioning the nibbler assembly so that the punching edge of the second blade section of the punch may be so positioned as to assume a position immediately above the notching piece formed as a result of the final cycle of processing, and then, by driving such punch downwardly to allow the punching edge of the second blade section to assume a heightwise level not exceeding the undersurface of the sheet material, a process takes place in which a portion of that notched piece, formed as a result of the final cycle of processing, on the downstream side with respect to the feed direction of the sheet material is punched and the remaining portion thereof is left remaining above the die. As described above, if that portion of the notched piece is allowed to remain, it is possible to avoid the seam substantially in the event that the notched piece, then remaining, and the sheet material portion on the upstream side of the notched piece are subsequently punched.

In the practice of the method of forming the elongated hole in the sheet material according to a preferred embodiment of the present invention, the starting end punching step referred to previously may be so designed as to form a punched hole by punching a portion of the depressed piece on the upstream side with respect to the feed direction of the sheet material and the sheet material portion on the upstream side thereof. The terminating end punching step referred to previously may be so designed as to punch a portion of the notched piece, formed during the final cycle of the nibbling step, on the downstream with respect to the feed direction of the sheet material.

In this method of forming the elongated hole in the sheet material, the starting end punching step referred to above includes positioning the nibbler assembly so that the punching edge on the downstream side of the first blade section of the punch may be positioned so as to assume a position immediately above the depressed piece. Then, the punch is driven downwardly so that the whole or a portion of the notching and punching edge of the second blade section may assume a heightwise level not exceeding the upper surface of the sheet material, and, at the same time, so that the punching edge of the second blade section may assume a heightwise level exceeding the upper surface of the sheet material. By so doing, a portion of the depressed piece on the upstream side with respect to the feed direction of the sheet material and a sheet material portion on the upstream side of the depressed piece are punched to form a punched hole while the remaining portion of the depressed piece is left on the die and, also, a notch extending towards the upstream side of the punched hole is formed by the second blade section following the punched hole, with an inner side portion of such notch being depressed downwardly to form a notched piece. Accordingly, no seam or substantially no seam remains at that end where the notch of the depressed piece and the punched hole overlap with each other. The notched piece is downwardly deformed towards a tip end side and remains connected at its base end with the main body portion of the sheet material.

The terminating end punching step referred to previously includes positioning the nibbler assembly so that the punching edge of the second blade section of the punch may be so positioned as to assume a position immediately above the notching piece formed as a result of the final cycle of processing. Then, such punch is driven downwardly to allow the punching edge of the second blade section to assume a heightwise level not exceeding the undersurface of the sheet material. By so doing, a portion of that notched piece, formed as a result of the final cycle of processing, on the downstream side with respect to the feed direction of the sheet material is punched and the remaining portion thereof is left remaining above the die.

According to this method of forming the elongated hole in the sheet material, that portion of the depressed piece and that portion of the notched piece remain respectively on the downstream and upstream sides of the completed elongated hole with respect to the feed direction of the sheet material. For this reason, in the event that the remaining portions of the depressed piece and the notched piece and sheet material portions following them are subsequently punched by a separate punching die, it is possible to substantially avoid the seam remaining at that portion where the elongated hole and the punched hole overlap with each other. By way of example, when a window opening is to be formed, an elongated hole is formed along each of the sides of the window opening by this elongated hole forming method and corner portions of the window opening are finally punched by a separate punching die, resulting in formation of the window opening with no seam or substantially no seam left in the corner portions.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

The above and other elements, features, steps, characteristics and advantages of the present invention will become more apparent from the following detailed description of the preferred embodiments with reference to the attached drawings.

BRIEF DESCRIPTION OF THE DRAWINGS

In any event, the present invention will become more clearly understood from the following description of preferred embodiments thereof, when taken in conjunction with the accompanying drawings. However, the preferred embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like elements throughout the several views.

DETAILED DESCRIPTION OF THE PREFERRED EMBODIMENTS

Hereinafter, preferred embodiments of the present invention will be described in detail with reference to the accompanying drawings.

Figure 1:
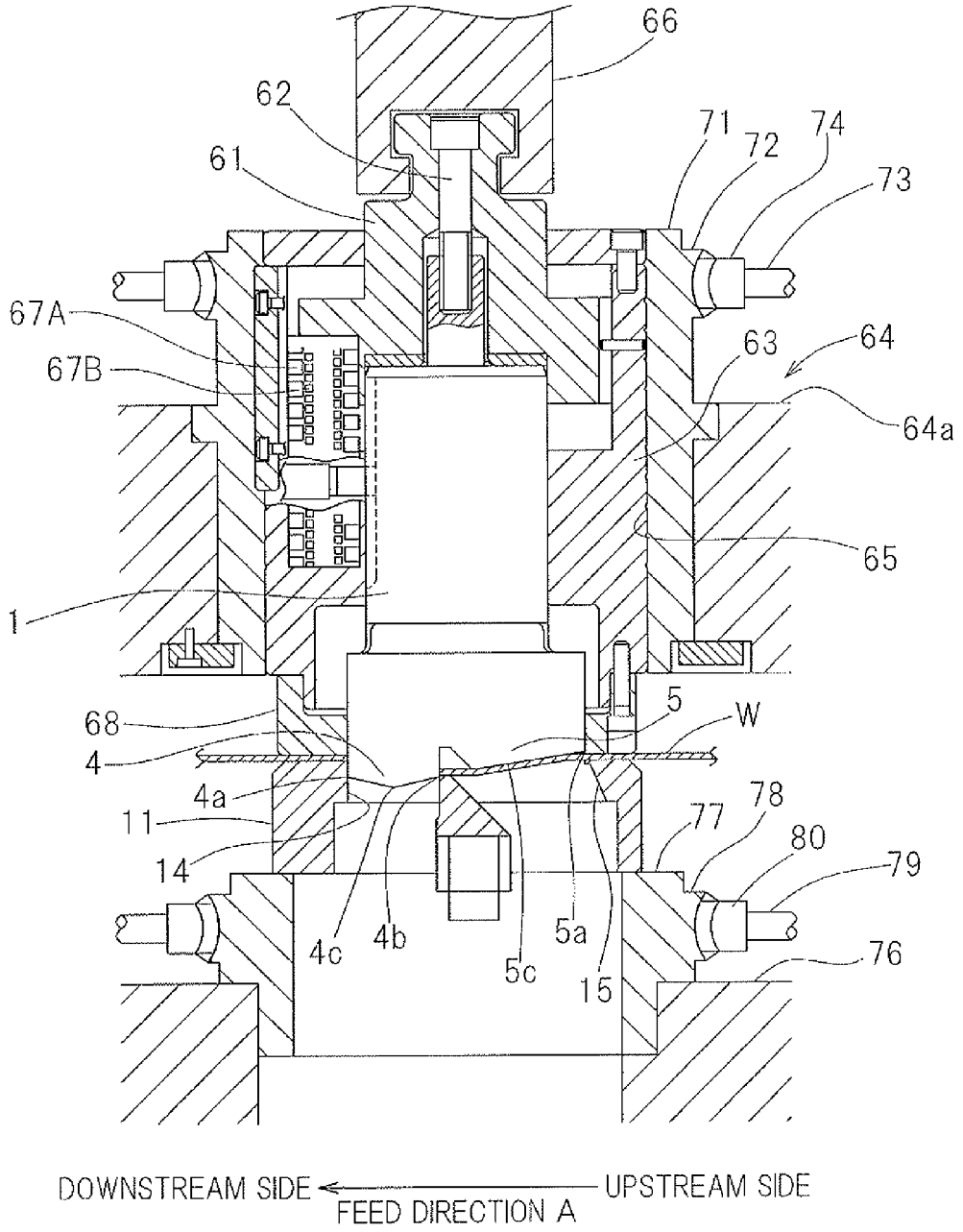
FIG. 1 is a sectional view showing a die mounting portion of a punching press having mounted thereon a nibbler assembly designed in accordance with a first preferred embodiment of the present invention.

FIG. 1 illustrates a die mounting portion of a punching press having mounted thereon a nibbler assembly designed in accordance with a first preferred embodiment of the present invention. The nibbler assembly includes a punch 1 and a die 11 and, with a sheet material W placed horizontally above the die 11, the punch 1 is driven towards the sheet material W to perform a punching process.

Figure 2A:
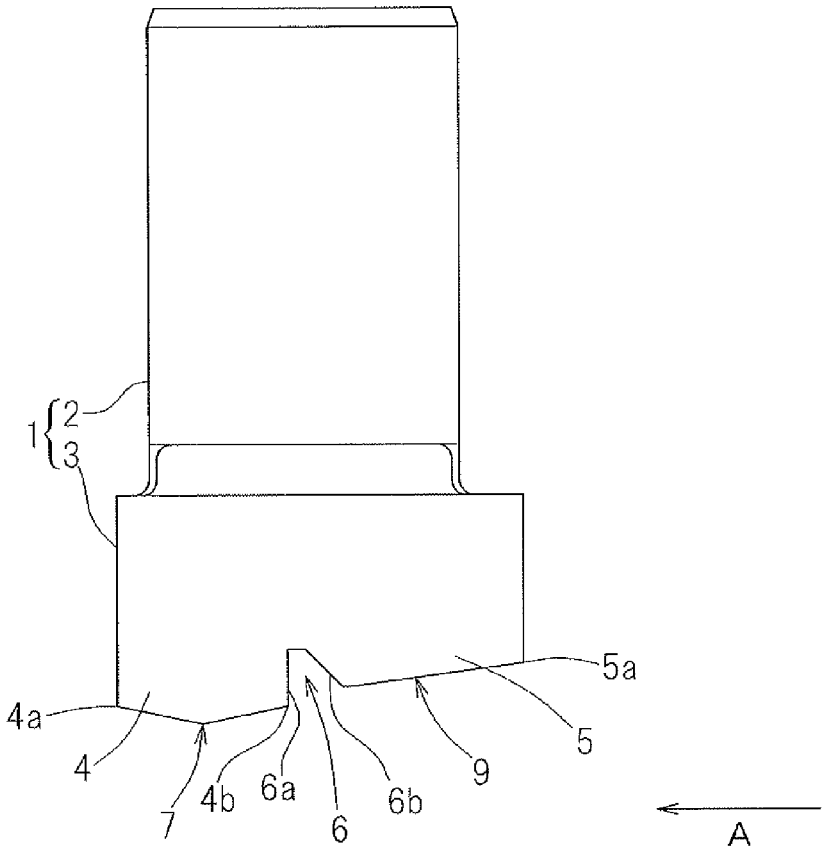
FIG. 2A is a front elevational view of a punch of the nibbler assembly.
Figure 2B:
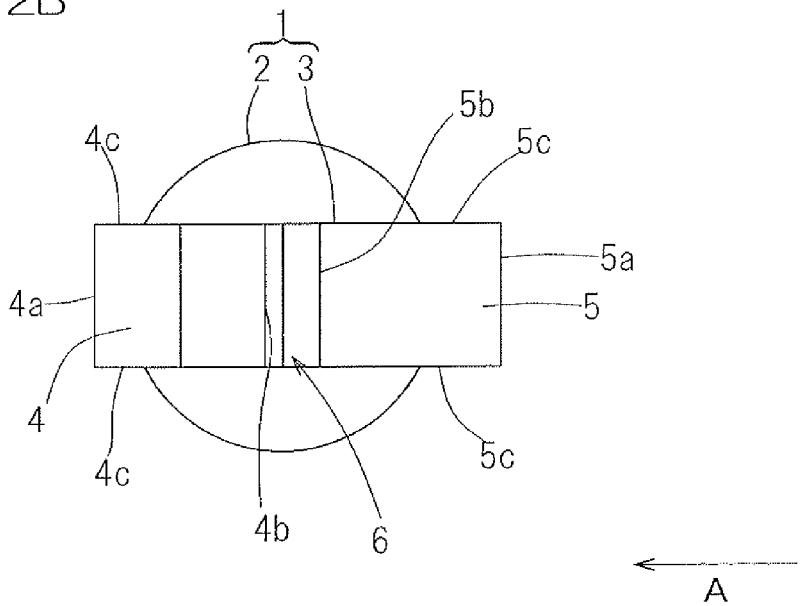
FIG. 2B is a bottom plan view of the punch.

As shown in FIGS. 2A and 2B, the punch 1 includes a shank portion 2 and a blade member 3 provided at a lower end of the shank portion 2. The blade member 3 is of a rectangular sectional shape and its lower end includes a first blade section 4 and a second blade section 5 juxtaposed in a widthwise direction, that is, in a direction parallel or substantially parallel to a feed direction A of a sheet material (a leftward and rightward direction as viewed in FIGS. 2A and 2B). Accordingly, the first blade section 4 and the second blade section 5 are of the same thickness and have their side surfaces held in flush with each other. A groove-shaped escape recess 6 is defined between the first blade section 4 and the second blade section 5. An inner wall surface 6*a* of the escape recess 6 adjacent to the first blade section 4 represents a surface lying in a vertical direction and an inner wall surface 6*b* of the escape recess 6 adjacent to the second blade section 5 represents a surface inclined with its lower end side gradually approaching the second blade section 5. It is to be noted that a right portion of the drawing of each of FIGS. 2A and 2B represents an upstream side with respect to the feed direction A of the sheet material and a left portion thereof represents a downstream side.

The first blade section 4 protrudes in a direction downwardly of the second blade section 5 while a step lies between the first and the second blade sections 4 and 5. A bottom surface 7 of the first blade section 4 represents a shape such that an intermediate portion of the feed direction A of the sheet material protrudes downwardly and that a direction perpendicular or substantially perpendicular to the feed direction A of the sheet material (an up and down direction as viewed in FIG. 2B) lies at the same heightwise level. Of the four lower end edges defining the outer perimeter of the bottom surface 7, the lower end edges on the upstream and downstream sides with respect to the feed direction A of the sheet material are rendered to be punching edges 4*a* and 4*b* and the lower end edges on both sides with respect to the feed direction A of the sheet material are rendered to be notching and punching edges 4*c*. The first blade section 4 in the instance as shown has its bottom surface representing a V-shaped configuration when viewed in a direction perpendicular or substantially perpendicular to the feed direction A of the sheet material as clearly shown in FIG. 2A, but the most projecting portion at the intermediate may have a horizontally lying flat facial portion and, also, a portion continuing from the most projecting portion at the intermediate to both sides with respect to the feed direction A of the sheet material may represent a curved facial shape, for example, a columnar shape.

A bottom surface 9 of the second blade section 5 is of a shape inclined gradually upwardly away from the first blade section 4 and a direction perpendicular or substantially perpendicular to the feed direction A of the sheet material lies at the same heightwise level. Of the four lower end edges defining the perimeter of the bottom surface 9 as best shown in FIG. 2B, the lower end edge on the upstream side with respect to the feed direction A of the sheet material defines a punching edge 5*a* and the lower end edges on both sides with respect to the feed direction A of the sheet material define notching and punching edges 5*c*. The lower end edge on the downstream side with respect to the feed direction A of the sheet material defines an edge 5*b* that does not specifically participate in processing.

Figure 3A:
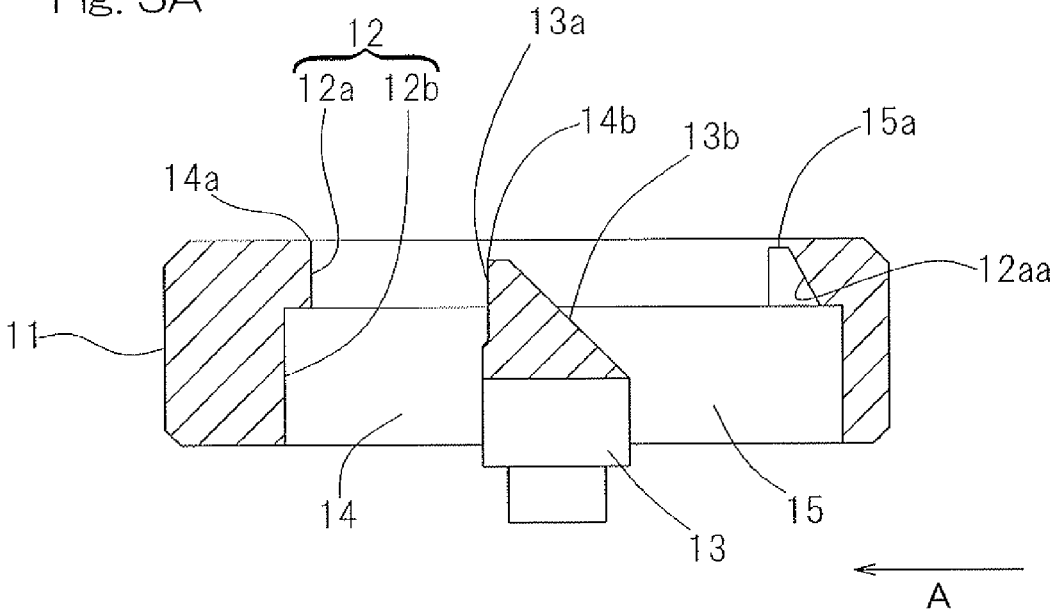
FIG. 3A is a broken front elevational view of a die of the nibbler assembly.
Figure 3B:
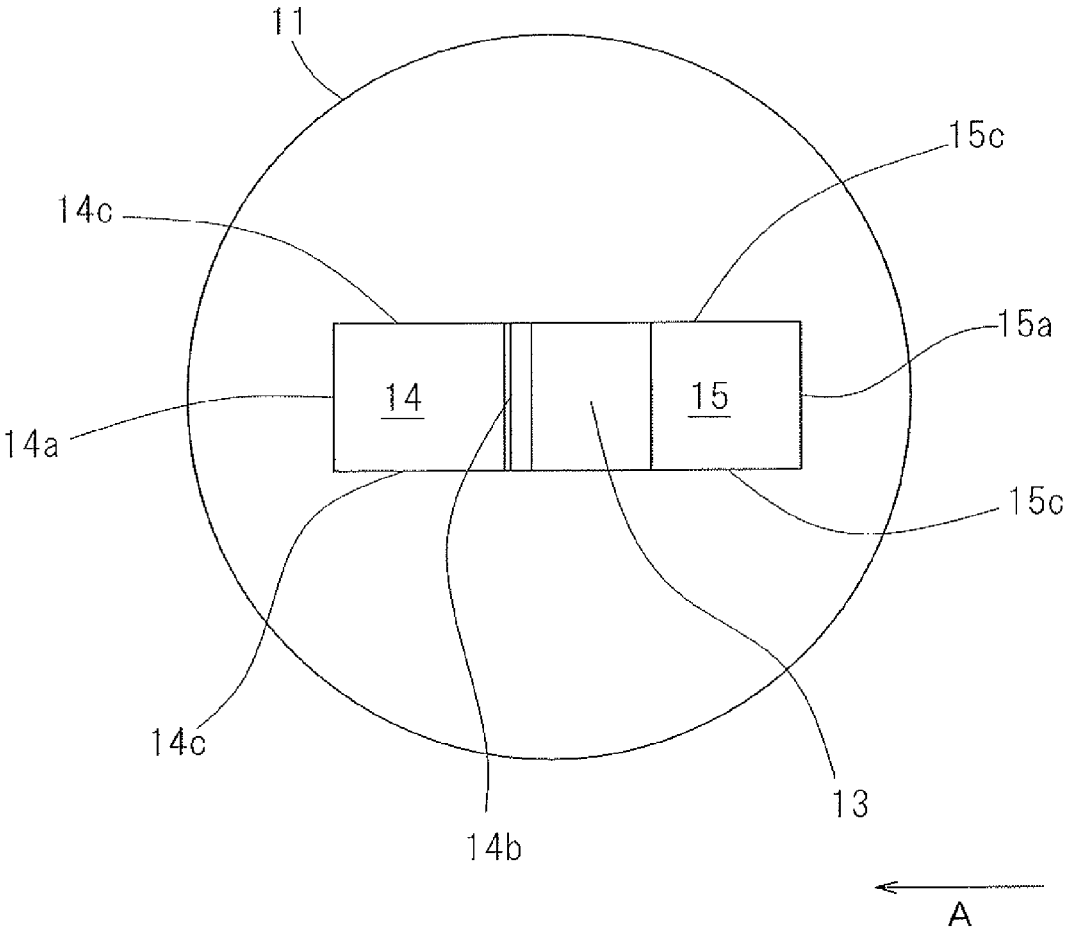
FIG. 3B is a top plan view of the die.

As shown in FIG. 3B, the die 11 has a round plane shape and, as shown in FIG. 3A, includes a blade section access hole 12, into which the first and second blade sections 4 and 5 of the punch 1, to extend up and down. This blade section access hole 12 is of a stepped hole long in a direction parallel or substantially parallel to the feed direction A of the sheet material and an upper hole portion 12*a* preferably has a transverse sectional shape sufficient to allow the blade member 3 of the punch 1 to be engaged therein. A wall surface of the upper hole portion 12*a* on the upstream side with respect to the feed direction A of the sheet material is an inclined surface 12*aa* including a lower side portion retracted towards an outer diametric side rather than an upper end portion thereof. The blade section access hole 12 is partitioned by a partition wall 13 at an intermediate portion of the feed direction A of the sheet material such that a hole portion on the downstream side with respect to the feed direction A of the sheet material defines a first throughhole 14, into which the first blade section 4 of the punch 1 enters, whereas a hole portion on the upstream side defines a second throughhole 15 into which the second blade section 5 of the punch 1 enters. A wall surface 13*a* of the partition wall 13 on the side of the first throughhole 14 is following the vertical direction and a wall surface 13*b* on the side of the second throughhole 15 is an inclined surface corresponding to the inner wall surface 6*b* of the escape recess 6 of the punch 1.

Of the four inner wall surfaces defining the first throughhole 14 shown in FIG. 3B, an upper end edges on the downstream and upstream sides with respect to the feed direction A of the sheet material define die side punching edges 14*a* and 14*b* engageable respectively with the punching edges 4*a* and 4*b* on the downstream and upstream sides of the first blade section 4 of the punch 1 and upper end edges of the wall facial portions along the feed direction A of the sheet material define die side notching and punching edges 14*c* engageable respectively with the notching and punching edges 4*c* of the first blade section 4 of the punch 1. Also, of the inner wall surfaces defining the second throughhole 15, an upper end edge of a wall facial portion on the upstream side with respect to the feed direction A of the sheet material defines a die side punching edge 15*a* engageable with the punching edge 5*a* of the second blade section 5 of the punch 1 and upper end edges of the wall facial portions along the feed direction A of the sheet material define die side notching and punching edge 15*c* engageable respectively with the notching and punching edges 5*c* of the second blade section 5 of the punch 1.

The punch 1 and the die 11 for the nibbler assembly described above are preferably used in the form as mounted on the punching press as shown in FIG. 1. The punch 1 is bolted to a head member 61 via a set bolt 62 and is inserted in a punch setting hole 65 of an upper turret 64 through a punch holder 63 for movement up and down. The head member 61 referred to above has a T-shaped head engaged with a ram 66 of a punch drive mechanism (not shown) so that it can be selectively raised and lowered. It is, however, to be noted that the punch drive mechanism may be of either a cranking type or a hydraulic type. The punch holder 63 is arranged to be movable up and down, but is normally biased by retainer springs 67A and 67B so as to assume a descended position and a stopper plate 68 is fitted to a lower end thereof.

The punch 1 is an indexing tool capable of performing an angle indexing. In other words, the punch setting hole 65 is provided in a rotary body 71 capable of rotating relative to a turret main body portion 64*a*. The rotary body 71 includes a worm wheel 72 provided on an outer peripheral surface thereof and a worm gear 74 provided on a rotary shaft 73, which worm gear 74 is disposed so as to be oriented radially of the turret 64 and is meshed with the worm wheel 72. Accordingly, when the rotary shaft 73 is driven by a drive device, its rotation is transmitted to the rotary body 71 through the worm gear 74 and the worm wheel 72 to allow the punch 1 to be indexed to a desired angle.

The die 11 is also rendered to be an indexing tool capable of performing an angle indexing. In other words, a die holder 77 is rotatably mounted on a turret 76 on a lower side and the die 11 is retained by this die holder 77. An outer surface of the die holder 77 includes a worm wheel 78 and a worm gear 80 provided on a rotary shaft 79, which worm gear 80 is disposed so as to be oriented in a direction parallel or substantially parallel to a radial direction of the turret 76 and is meshed with the worm wheel 78. When the rotary shaft 79 is driven by a driving device, its rotation is transmitted to the die holder 77 through the worm gear 80 and the worm wheel 78 to allow the die 11 to be indexed to a desired angle.

The upper and lower turrets 64 and 76 are punch or die support members to support various punches or dies required to perform a punching process at a plurality of circumferential locations and, as one of the installed punches or dies, the punch 1 and the die 11 for the nibbler assembly are installed. A punch (not shown) and a die (also not shown) for any purpose other than the nibbler assembly are also provided for angular indexing in a manner similar to those described above. It is to be noted that the punching press having those dies installed may not be necessarily limited to the turret type, but the punch and the die may be installed on a die support member separate from the turret.

Figure 4A:
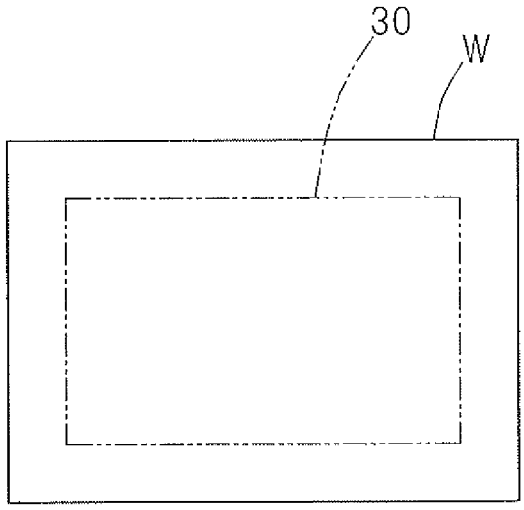
FIGS. 4A to 4F are diagrams showing a process of forming an elongated hole in a sheet material with the use of the nibbler assembly.
Figure 4B:
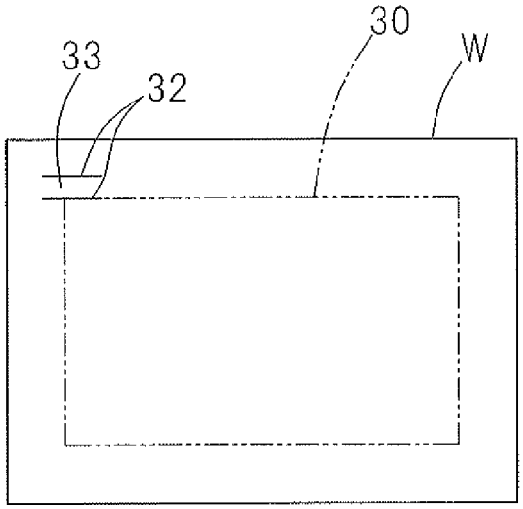
Figure 4C:
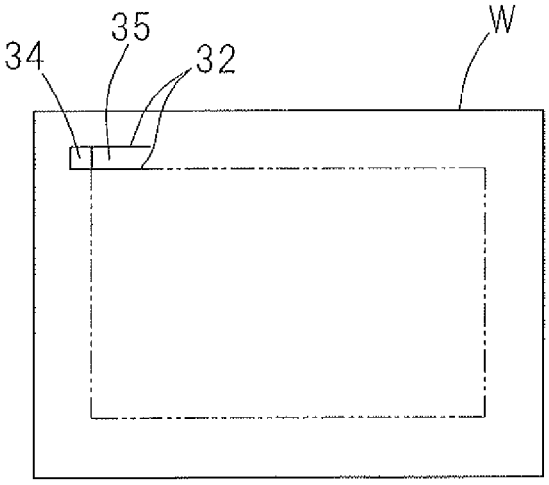
Figure 4D:
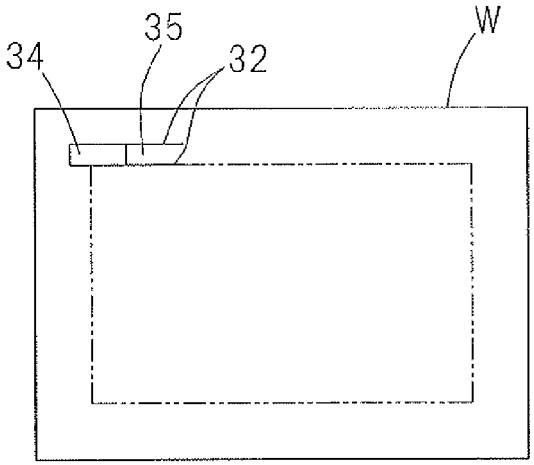

A method of performing the punching process with the use of the nibbler assembly including a combination of the punch 1 and the die 11 will now be described with particular reference to FIGS. 4A to 4F, which illustrate an example in which a rectangular product 30 is cut out from a sheet material W. To summarize it, nibbling is made along each side of the rectangular product 30 to form an elongated hole 31 (as shown in FIG. 4F) and the rectangular product 30 is cut out from the sheet material W with the elongated holes 31 in the four sides connected together. Formation of the elongated hole 31 is carried out sequentially in the order from a starting end notching step, a starting end punching step, a nibbling step and a terminating end punching step.

Figure 4F:
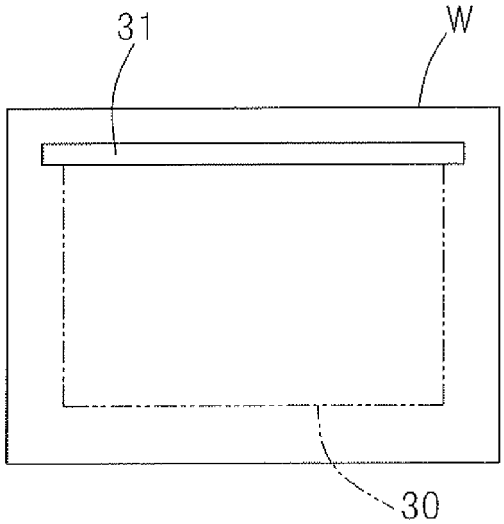
Figures 5A, 5B, 5C:
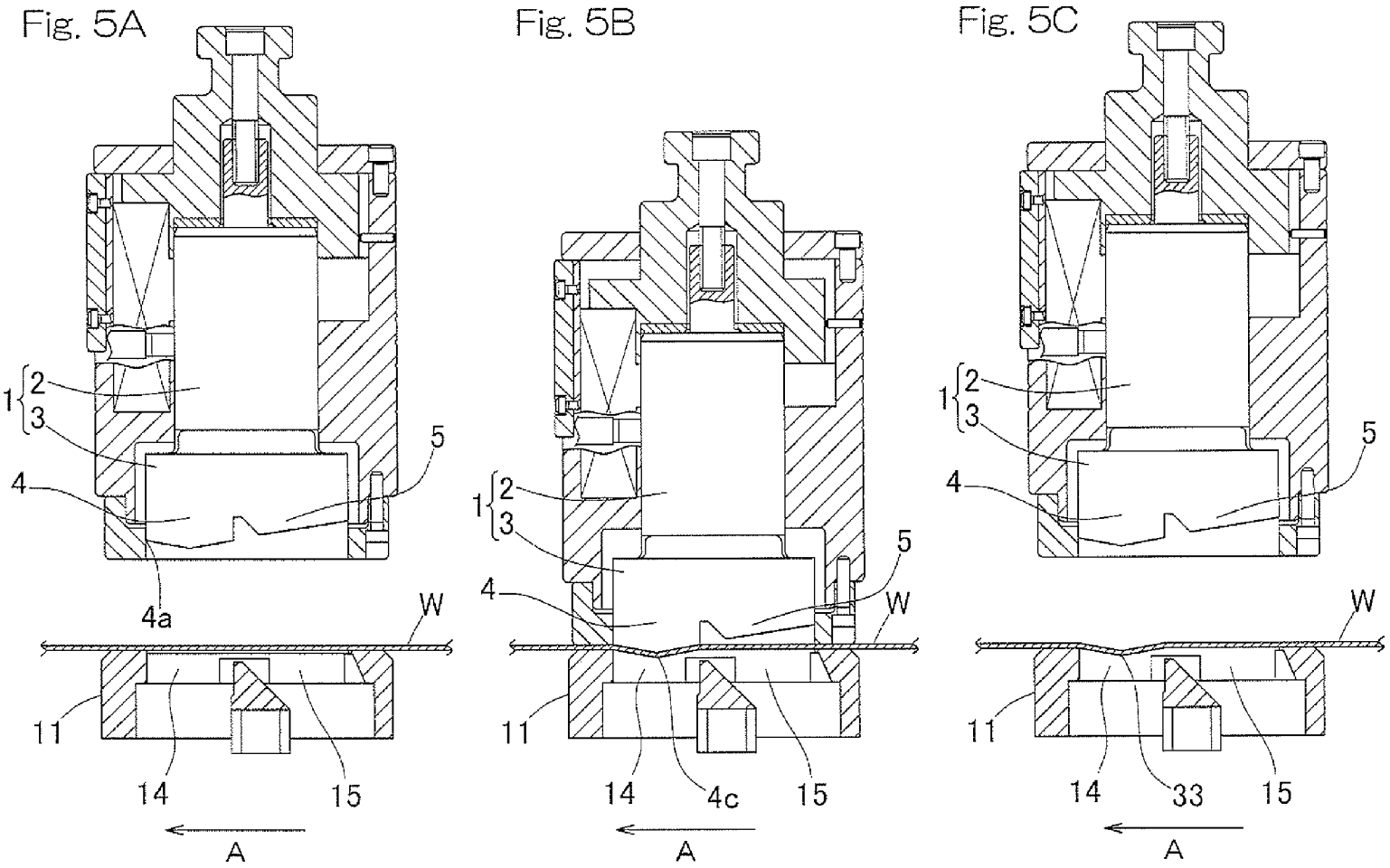
FIGS. 5A to 5C are sectional views of the die mounting portion, showing a first punch processing operation during a starting end notching step.

As shown in FIGS. 5A to 5C, the starting end notching step is carried out by positioning the nibbler assembly so that the position of the punching edge 4*a* on the downstream side of the first blade section 4 of the punch 1 is aligned with a starting end of the elongated hole 31 (best shown in FIG. 4F) that is to be formed in the sheet material W, or so that such a position may assume an upstream side of the starting end, and then, by down-striking the punch 1 of the nibbler assembly. The height of the punch 1, when at the most descended position (as shown in FIG. 5B), is chosen so that only the punching edge 4*c* may assume a heightwise level not exceeding an upper surface of the sheet material W. By so doing, a location of the sheet material W, which is positioned below the first blade section 4, is lowered by the first blade section 4 to form a depressed piece 33 having a notch 32 (as shown in FIG. 4B) in a direction parallel or substantially parallel to the feed direction A of the sheet material. The depressed piece 33 so formed is deformed most downwardly at an intermediate portion thereof with respect to the feed direction A of the sheet material, but is still connected with a main body portion of the sheet material W at opposite ends with respect to the feed direction A of the sheet material.

Figure 10A:
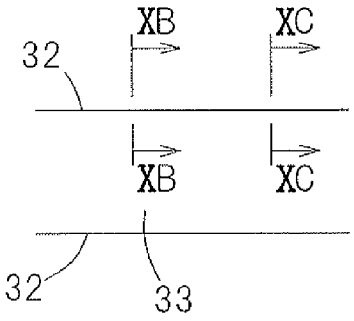
FIG. 10A is a top plan view showing a depressed piece.
Figure 10B:
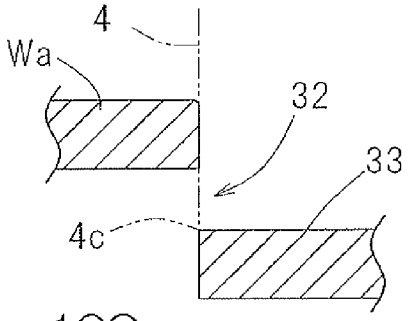
FIG. 10B is a cross sectional view taken along the line XB-XB in FIG. 10A.
Figure 10C:
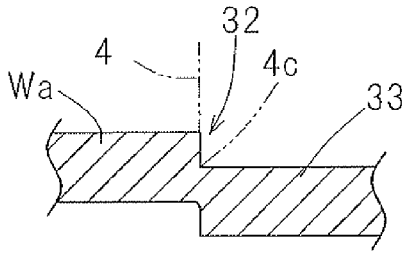
FIG. 10C is across sectional view taken along the line XC-XC in FIG. 10A.

The depressed piece 33 is shown on an enlarged scale in FIG. 10A. The depressed piece 33 has different aspects of the notch 32 between a portion thereof, which is formed by the intermediate portion of the notching and punching edge 4*c* of the first blade section 4 with respect to the feed direction A, and a portion thereof, which is formed by the opposite end portions of the notching and punching edge 4*c*. In other words, the notch 32 formed by the intermediate portion of the notching and punching edge 4*c* is such that, as shown in FIG. 10B, the depressed piece 33 is completely cut out from a main body portion Wa of the sheet material W, but the notch 32 formed by the opposite end portions of the notching and punching edge 4*c* are not completely cut out from the main body portion Wa of the sheet material W, but are connected therewith with a step intervening therebetween as best shown in FIG. 10C. The size of the step between the depressed piece 33 and the main body portion Wa of the sheet material W shown in FIG. 10C is gradually reduced towards the opposite ends of the depressed piece 33 and attains zero at the opposite ends thereof. Since in this way the depressed piece 33 is not separated from the main body portion Wa of the sheet material W, but notches 32 are so formed as to leave the step between the main body portion Wa and the depressed piece 33, which is of a size that gradually decreases, the sheet material W will not undergo a processed hardening in the vicinity of the opposite ends of the notch 32 and substantially no roll-over is formed in a punched surface and a cut surface either.

Figures 6A, 6B, 6C:
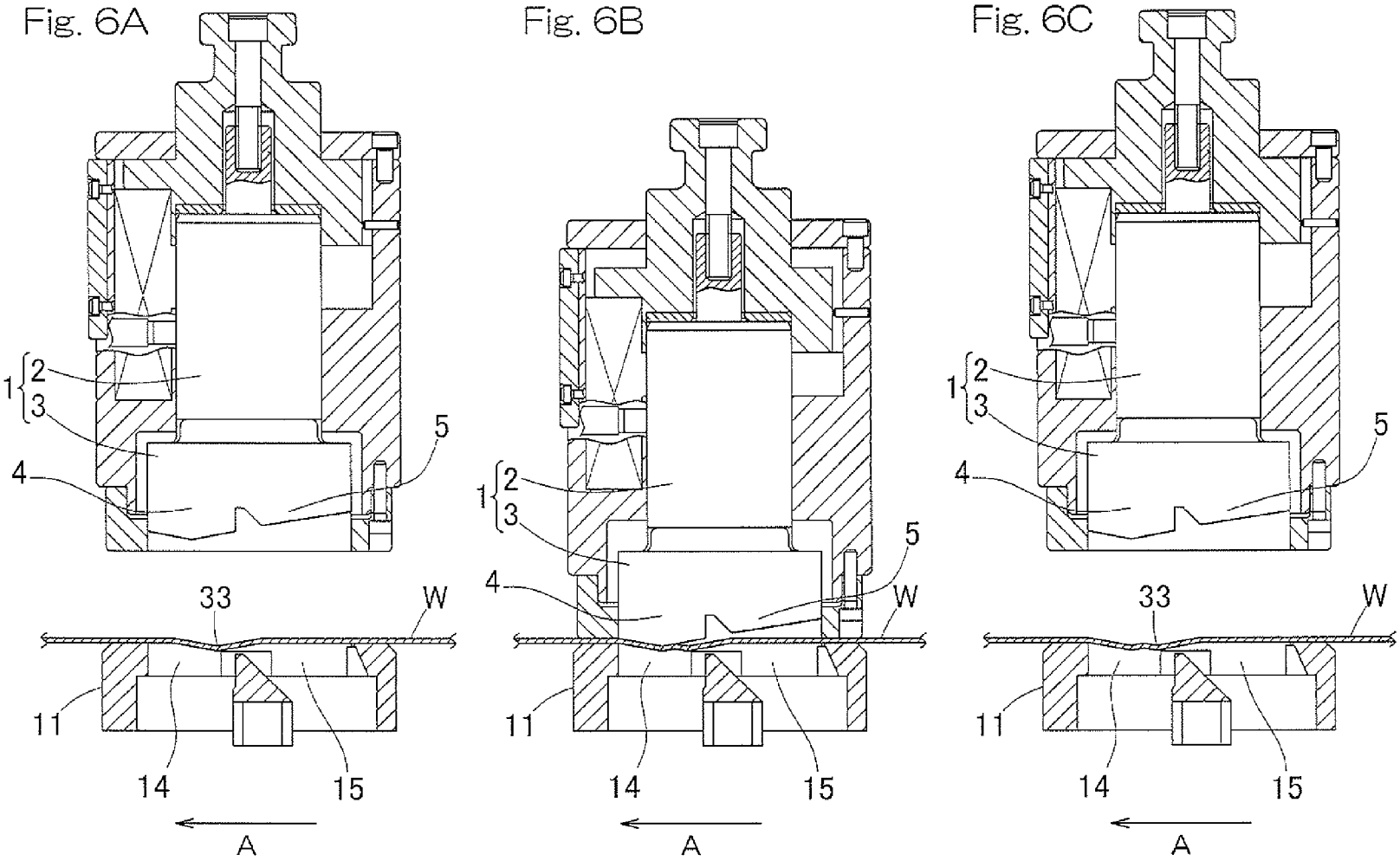
FIGS. 6A to 6C are sectional views of the die mounting portion, showing a second punch processing operation during the starting end notching step.

Thereafter, as shown in FIGS. 6A to 6C, while the sheet material W is displaced by a distance towards the upstream side (rightwards as viewed in the figure) with respect to the feed direction A, specifically the nibbler assembly is relatively displaced by a distance relative to the sheet material W towards the downstream side with respect to the feed direction A, the processing of the starting end notching step similar to that described above is carried out to increase the length of the depressed piece 33 in a direction parallel or substantially parallel to the feed direction A. This is for the purpose that during the subsequent starting end punching step, the notch 32 following a punched hole 34 can be formed. The processing of the starting end notching step is performed a number of times before the notch 32 of a proper length is obtained.

Figures 7A, 7B, 7C:
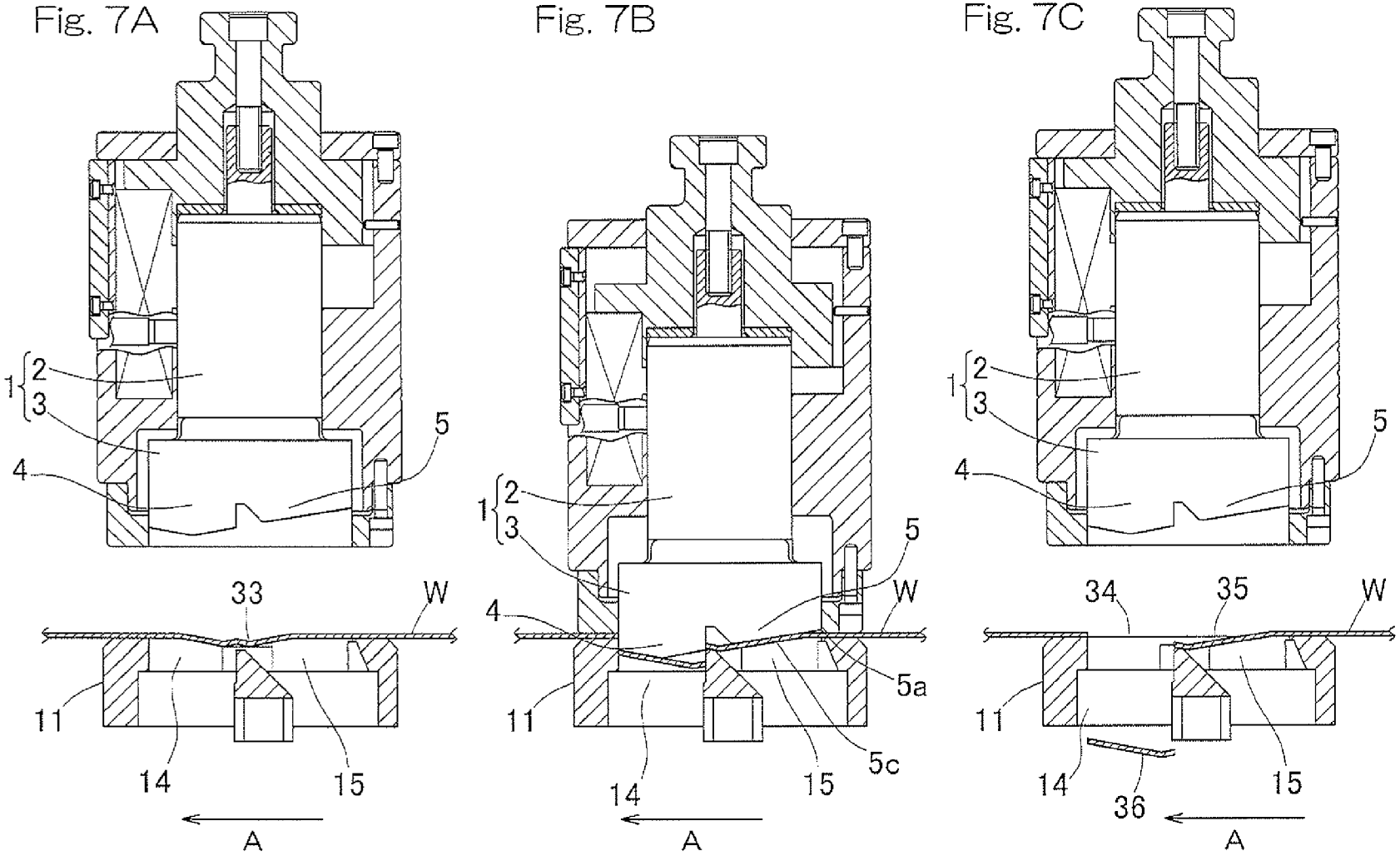
FIGS. 7A to 7C are sectional views of the die mounting portion, showing a punch processing operation during the starting end punching step.

The starting end punching step is carried out by positioning the nibbler assembly so that the position of the depressed piece 33 with respect to the feed direction A may straddle between the first blade section 4 and the second blade section 5, and then by descending the punch 1 of the nibbler assembly as shown in FIGS. 7A to 7C. The height of the punch 1, when at the most descended position (shown in FIG. 7B), is chosen so that the whole or a portion of a notching and punching edge 5*c* of the second blade section 5 may assume a heightwise level not exceeding the upper surface of the sheet material W, but the punching edge 5*a* of the second blade section 5 may assume a heightwise level exceeding the upper surface of the sheet material W. By so choosing, a sheet material portion including the depressed piece 33 is punched by the first blade section 4 to form a punched hole 34, and to form a notch 32 (best shown in FIG. 4C) is formed by the second blade section 5, which notch 32 extends from the punched hole 34 towards the upstream side with respect to the feed direction A, with an inner side portion of the notch 32 being downwardly depressed to leave a tongue-shaped notched piece 35. A punched piece 36, which has been punched, falls through the first throughhole 14 of the die 11. The notched piece 35 has its base end continued with the main body portion of the sheet material W.

As described previously, since no processed hardening occurs in the sheet material W in the vicinity of the opposite ends of the notch 32 which has been formed by the first blade section 4 during the previously described starting end notching step, even though during the starting end punching step the depressed piece 33 is punched by the first blade section 4, no seam, which tends to occur in an overlap area between the notch 32 of the depressed piece 33 and the punched hole 34 when punched holes are continuously and individually formed, is left therein. As is the case with the depressed piece 32, the sheet material W does not undergo the processed hardening in the vicinity of the base end of the notch 32 and roll-over does not occur in a punched surface or in the cut surface either.

Figure 11A:
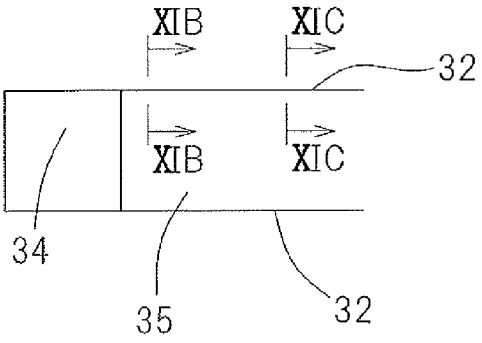
FIG. 11A is a top plan view of a notched piece.
Figure 11B:
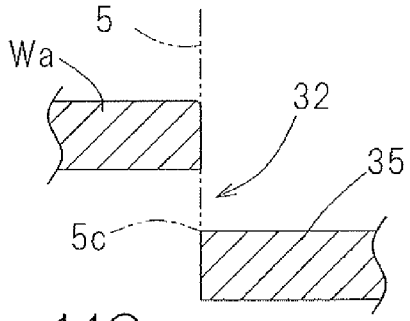
FIG. 11B is a cross sectional view taken along the line XIB-XIB in FIG. 11A.
Figure 11C:
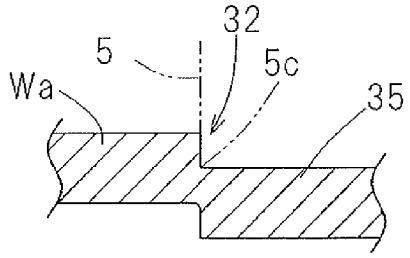
FIG. 11C is a cross sectional view taken along the line XIC-XIC in FIG. 11A.

The notched piece 35 is shown on an enlarged scale in FIG. 11A. The notched piece 35 includes different aspects of the notch 32 between a portion thereof, which is formed by an downstream side portion of the notching and punching edge 5*c* of the second blade section 5 with respect to the feed direction A, and at a portion thereof, which is formed by the upstream side portion. In other words, the notch 32 formed by the downstream side portion of the notching and punching edge 5*c* is such that, as shown in FIG. 11B, the notched piece 35 is completely separated from the main body portion Wa of the sheet material W as a result of being punched, but the notch 32 formed by the upstream side portions of the notching and punching edge 5*c* is not completely punched from the main body portion Wa of the sheet material W and are connected therewith with a step created between the notched piece 35 and the main body portion Wa of the sheet material W as best shown in FIG. 11C. The size of the step between the notched piece 35 and the main body portion Wa of the sheet material W is gradually decreased towards the base end of the notched piece 35 and attains zero at such base end thereof. Since in this way the notched piece 35 is not separated from the main body portion Wa of the sheet material W, but the notch 32 is formed so as to leave the step between the main body portion Wa and the notched piece 35, which is of a size that gradually decreases, the sheet material W will not undergo a processed hardening in the vicinity of the base end of the notch 32 and substantially no roll-over is formed in a punched surface and a cut surface either.

Figure 8C:
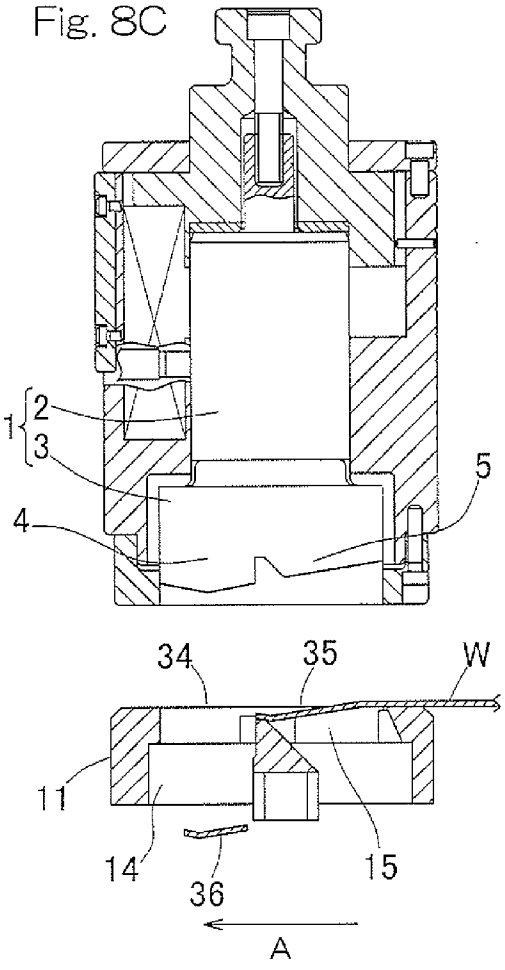
FIGS. 8A to 8C are sectional views of the die mounting portion, showing a punch processing operation during a nibbling step.
Figure 8B:
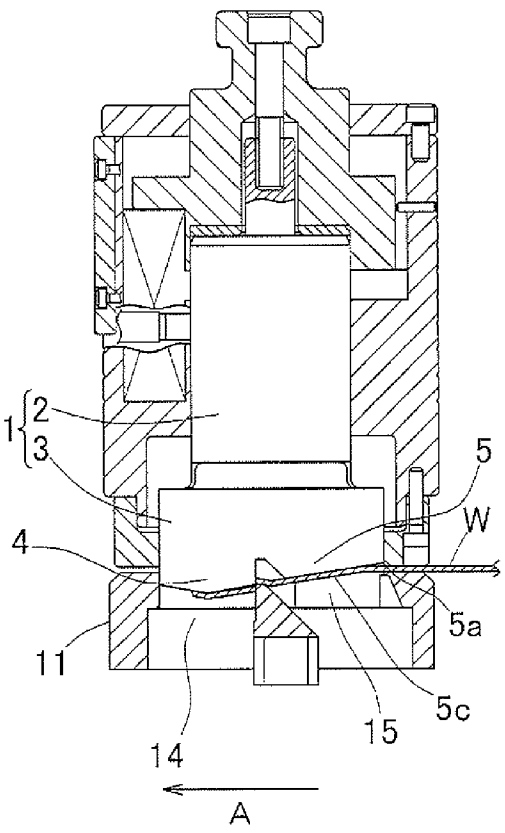
Figure 8A:
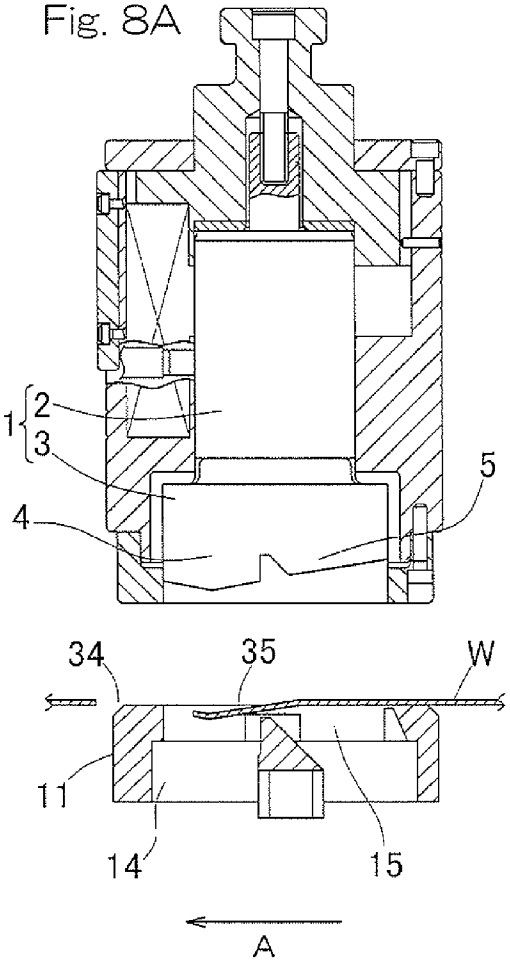

The nibbling step is carried out a number of times while the nibbler assembly is moved along an outer edge of the intended produce 30. As shown in FIGS. 8A to 8C, the nibbling step is such that the nibbler assembly is positioned so as to allow the position of the notched piece 35, formed during the starting end punching step or the previous nibbling step, to straddle between the first blade section 4 and the second blade section 5, and then, the punch 1 of the nibbler assembly is stricken downwardly. The height of the punch 1, when at the most descended position (as shown in FIG. 8B), is chosen so that the whole or a portion of the notching and punching edge 5*c* of the second blade section 5 may assume a heightwise level not exceeding the upper surface of the sheet material W, but the punching edge 5*a* of the second blade section 5 may assume a heightwise level exceeding the upper surface of the sheet material W. By so choosing, a sheet material portion including the notched piece 35 is punched by the first blade section 4 to form a punched hole 34, and a new notch 32 (best shown in FIG. 4D) is formed by the second blade section 5, which notch 32 extends from the punched hole 34 towards the upstream side with respect to the feed direction A, with an inner side portion of such notch 32 being downwardly depressed to leave a new notched piece 35.

As described previously, since no processed hardening occurs in the sheet material W in the vicinity of the base end of the notched piece 35, substantially no seam, which tends to occur in an overlap area between the notch 32 of the depressed piece 33 and the punched hole 34, is left therein.

Figure 4E:
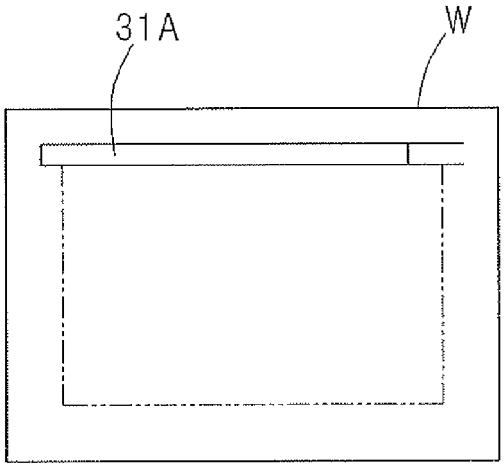
Figures 9A, 9B, 9C:
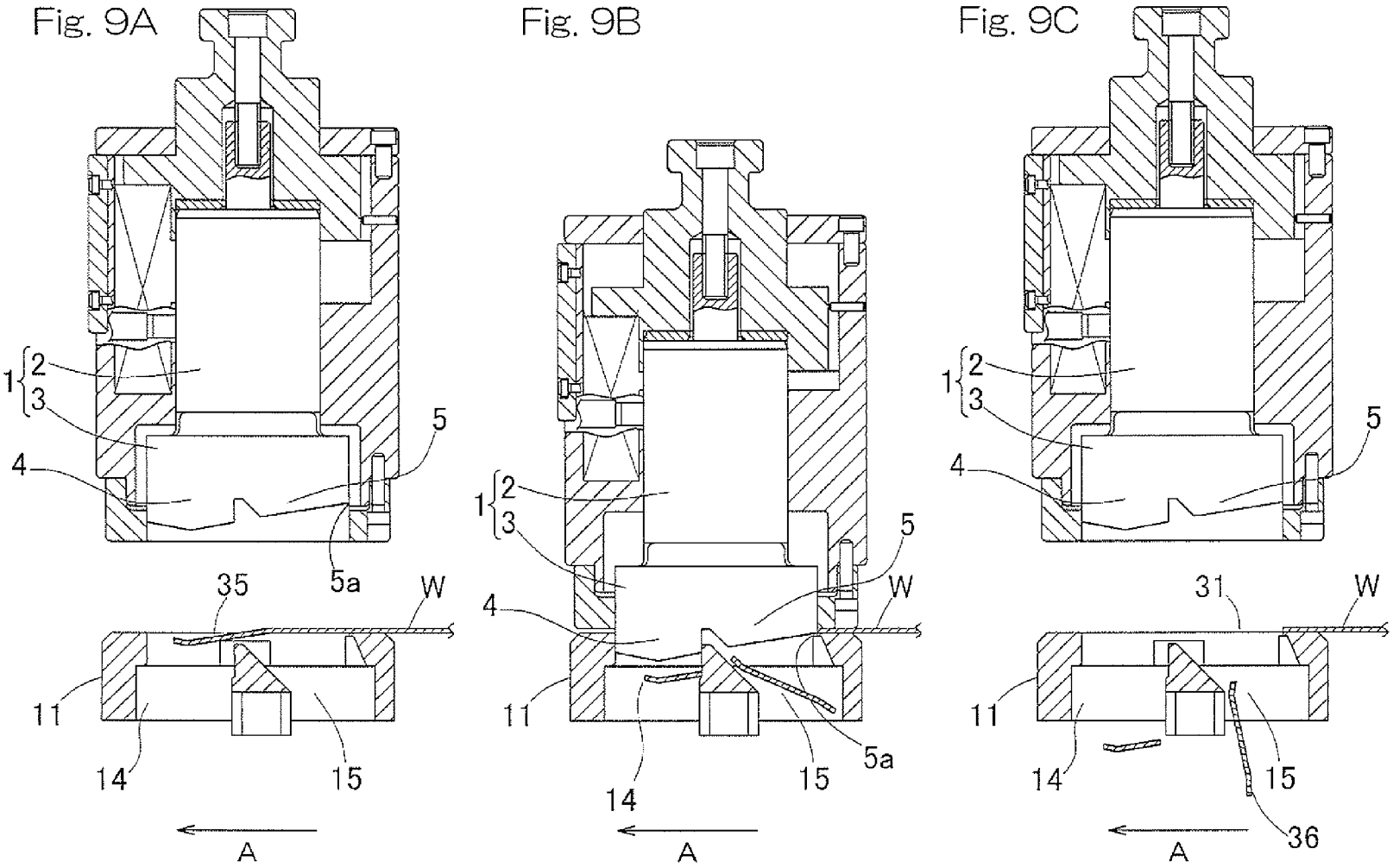
FIGS. 9A to 9C are sectional views of the die mounting portion, showing the punch processing operation during a terminal end punching step.

An elongated hole 31A is formed by the punched holes 34 then overlapping one after another, which holes 34 are formed during the starting end punching step and each of the nibbling steps, and when a tip end of the elongated hole 31A reaches a position immediately preceding a terminating end of an intended elongated hole 31 (as shown in FIG. 4E), a processing of the terminating end punching step is carried out. The terminating end punching step is as shown in FIGS. 9A to 9C, the nibbler assembly is positioned so that the position of the notched piece 35, which has been formed during the final cycle of the nibbling steps, with respect to the feed direction A, straddles the first blade section 4 and the second blade section 5 and, at the same time, so that the position of the punching edge 5*a* of the second blade section 5 with respect to the feed direction A may be aligned with a terminating end of the elongated hole 31 to be formed in the sheet material W, and then, the punch 1 of the nibbler assembly is stricken downwardly. The height of the punch 1, when at the most descended position (as shown in FIG. 9B), is chosen so as to allow the punching edge 5*a* of the second blade section 5 to assume a heightwise level not exceeding the lower surface of the sheet material W. By so choosing, the notched piece 35 formed during the final cycle of the nibbling steps is punched and the intended elongated hole 31 is thus formed as shown in FIG. 4F. A punched piece 36 is allowed to fall downwards through the second throughhole 15 defined in the die 11.

In a manner similar to that described above, an elongated hole 31 is formed along each side of the product 30, and the product 30 is cut out (not shown) when the elongated holes 31 along the sides of the product 30 are connected together. No seam or substantially no seam is left anywhere in the perimeter of the cut-out product 30.

Figure 12:
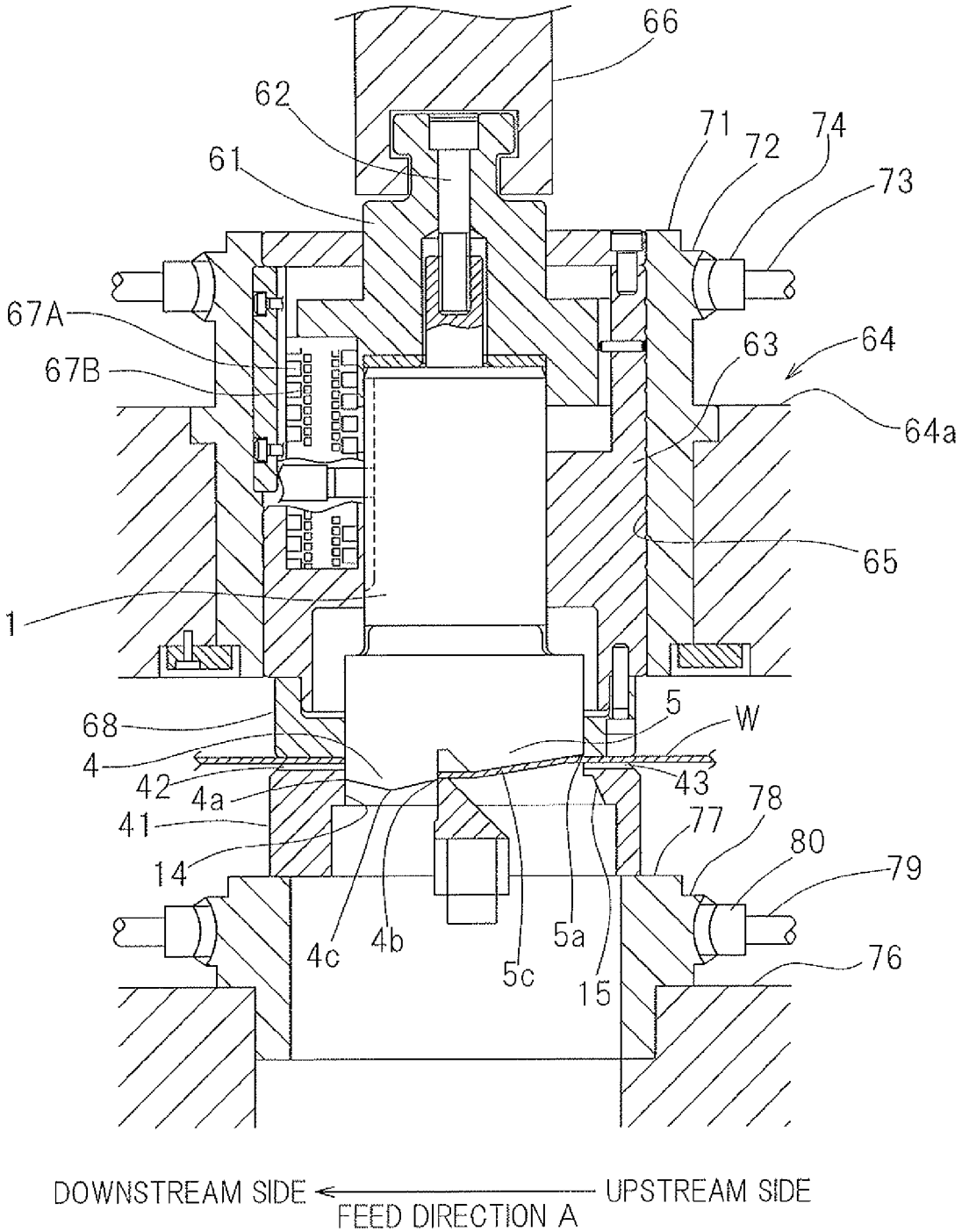
FIG. 12 is a sectional view showing the die mounting portion of the punching press having mounted thereon the nibbler assembly designed in accordance with a second preferred embodiment of the present invention.

FIG. 12 illustrates a die mounting portion of the punching press, on which the nibbler assembly designed in accordance with a second preferred embodiment of the present invention is mounted. The nibbler assembly includes the punch 1 and a die 41. The punch 1 of this nibbler assembly preferably is of the same shape as the punch 1 used in the practice of the previously described preferred embodiment of the present invention and, therefore, the details of such punch 1 are neither shown nor described. Where the nibbler assembly shown in FIG. 1 and the nibbler assembly shown in FIG. 12 are desired to be mounted on a single punching press, a dedicated punch 1 may be provided for each of those nibbler assemblies or a single punch 1 may be concurrently used with those double nibbler assemblies.

Figure 13A:
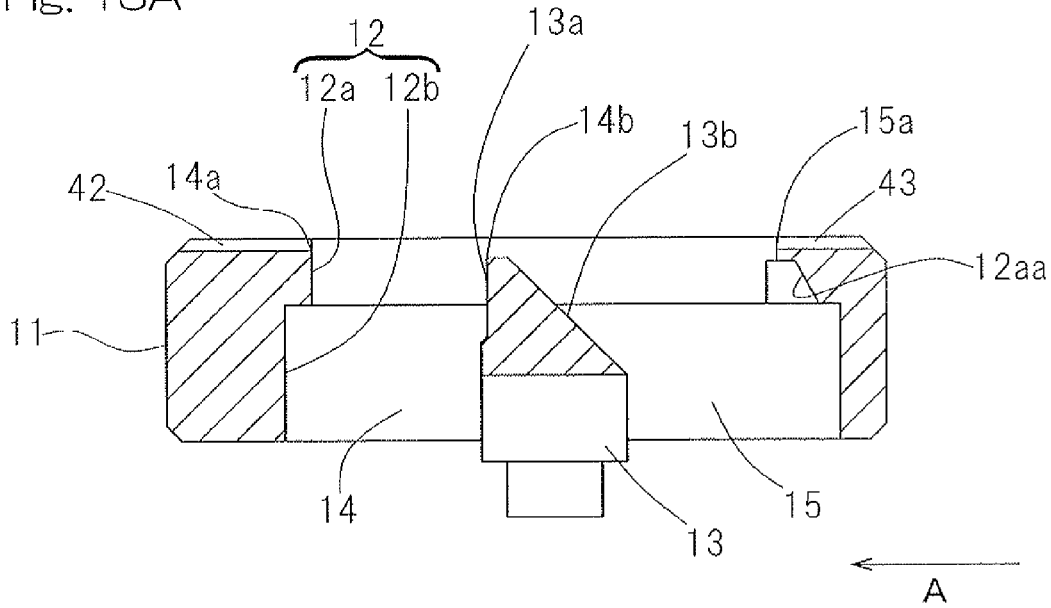
FIG. 13A is a broken front elevational view of the die of the nibbler assembly.
Figure 13B:
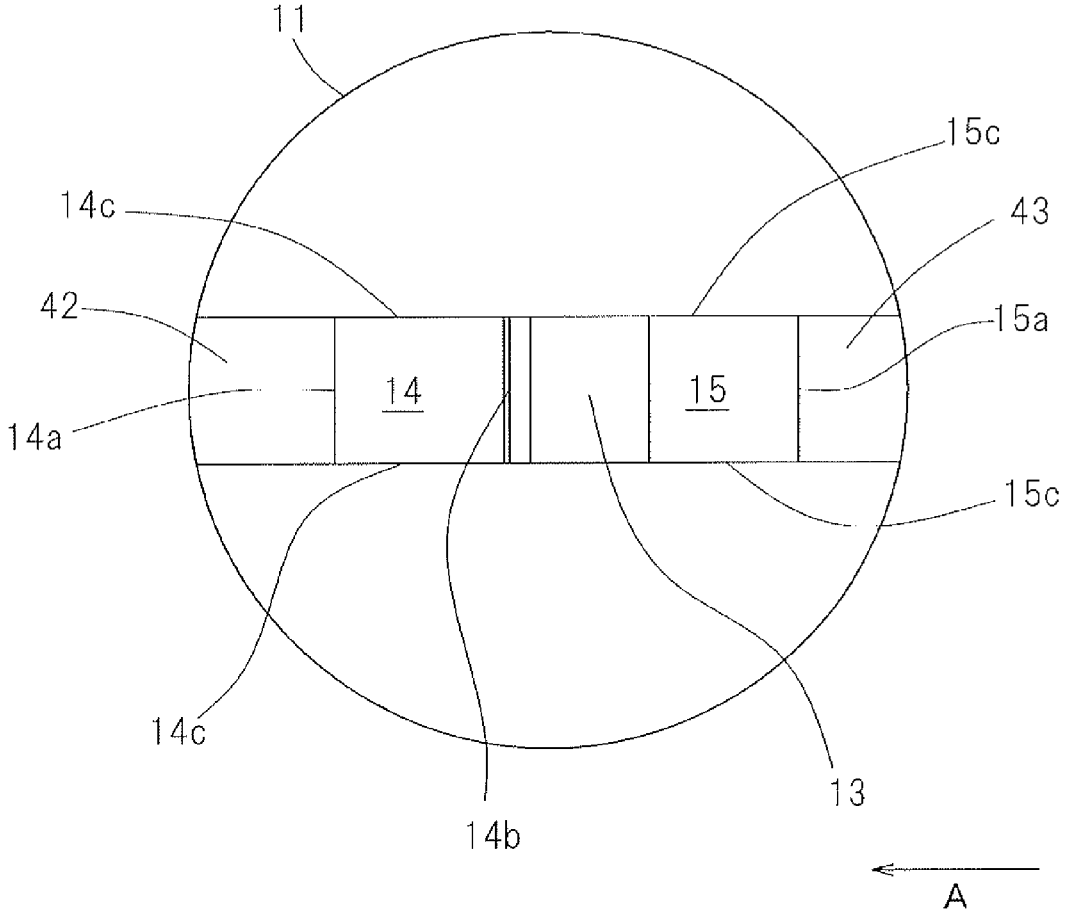
FIG. 13B is a top plan view of the die.

As shown in FIGS. 13A and 13B, the die 41 of the nibbler assembly is of a shape almost similar to that of the die 11 used in the practice of the previously described preferred embodiment of the present invention. In other words, the die 41 has the blade section access hole 12 including the first throughhole 14 and the second throughhole 15. Also, upper end edges of four inner wall surfaces forming the first throughhole 14 define the die side punching edges 14*a* and 14*b*, which are engageable with the punching edges 4*a* and 4*b* of the first blade section 4 of the punch 1, and the die side notching and punching edges 14*c* engageable with the notching and punching edges 4*c* of the first blade section 4. In addition, of the four inner wall surfaces defining the second throughhole 15, upper end edges of the three inner wall surfaces are rendered to be the die side punching edge 15*a*, engageable with the punching edge 5*a* of the second blade section 5 of the punch 1, and the die side notching and punching edges 15*c* engageable with the notching and punching edges 5*c* of the second blade section 5.

The first difference that makes the die 41 of this preferred embodiment different from that used in the practice of the previously described preferred embodiment lies in that a wall surface portion defining the die side punching edge 14*a* engageable with the punching edge 4*a* on the upstream side of the first blade section 4 of the punch 1 includes an upper end edge lower than a wall surface portion defining the die side notching and punching edges 14*c* engageable with the notching and punching edges 4*c* of the first blade section 4 of the punch 1. In a region ranging from a lower wall surface portion of the upper end edge towards the downstream side with respect to the feed direction A, a downstream side cutout 42 is provided, which includes an upper surface lower in height than the other portion.

Also, the second difference that makes the die 41 of this preferred embodiment different from that used in the practice of the previously described preferred embodiment lies in that a wall surface portion defining the die side punching edge 15*a*, engageable with the punching edge 5*a* of the second blade section 5 of the punch 1, includes an upper end edge lower than a wall surface portion forming the die side notching and punching edges 15*c* engageable with the notching and punching edges 5*c* of the second blade section 5 of the punch 1. In a region ranging from a lower wall surface portion of the upper end edge towards the upstream side with respect to the feed direction A, an upstream side cutout 43 is provided, which includes an upper surface lower in height than the other portion.

Figure 14A:
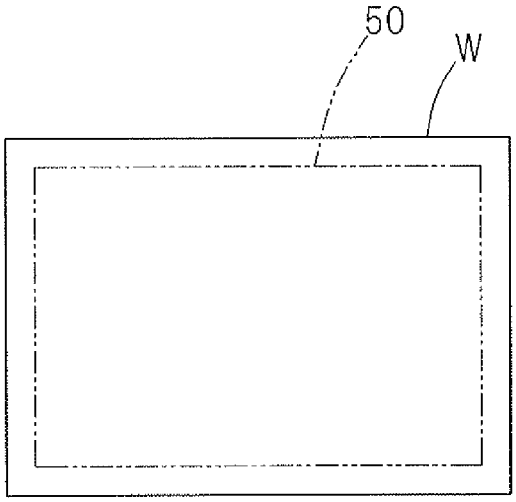
FIGS. 14A to 14F are diagrams showing the process of forming the elongated hole in the sheet material with the use of the nibbler assembly.
Figure 14B:
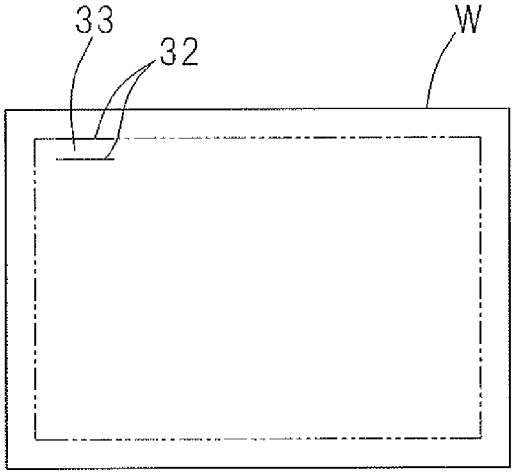
Figure 14C:
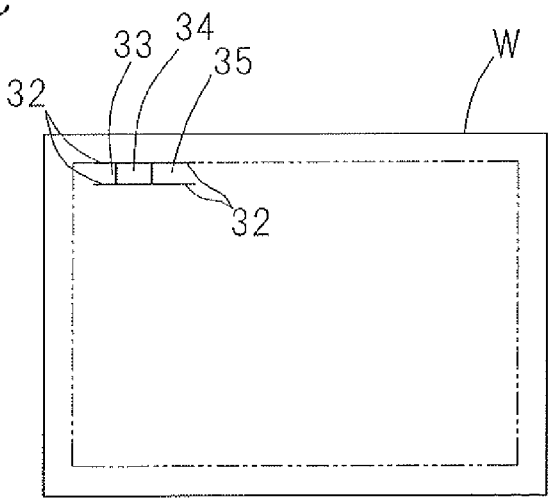

A method of performing the punching process with the use of the nibbler assembly including a combination of the punch 1 and the die 41 will now be described with particular reference to FIGS. 14A to 14F by way of an example in which the sheet material W is processed to form a rectangular window opening 50 as best shown in FIG. 14A. To summarize it, nibbling is performed along each side of the rectangular window opening 50 to form an elongated hole 51 (as shown in FIG. 14E) to thereby establish such a condition as shown in FIG. 14F and, finally, a remaining piece 53 left at a corner portion is punched with the use of a different nibbler assembly (not shown) to complete the window opening 50. Formation of the elongated hole 51 is carried out sequentially in the order from a starting end notching step, a starting end punching step, a nibbling step and a terminating end punching step.

Figure 14E:
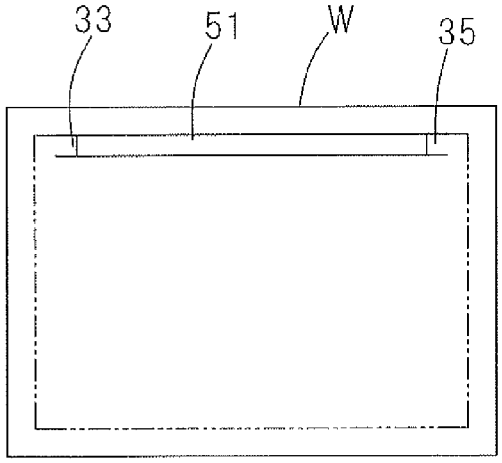
Figures 15A, 15B, 15C:
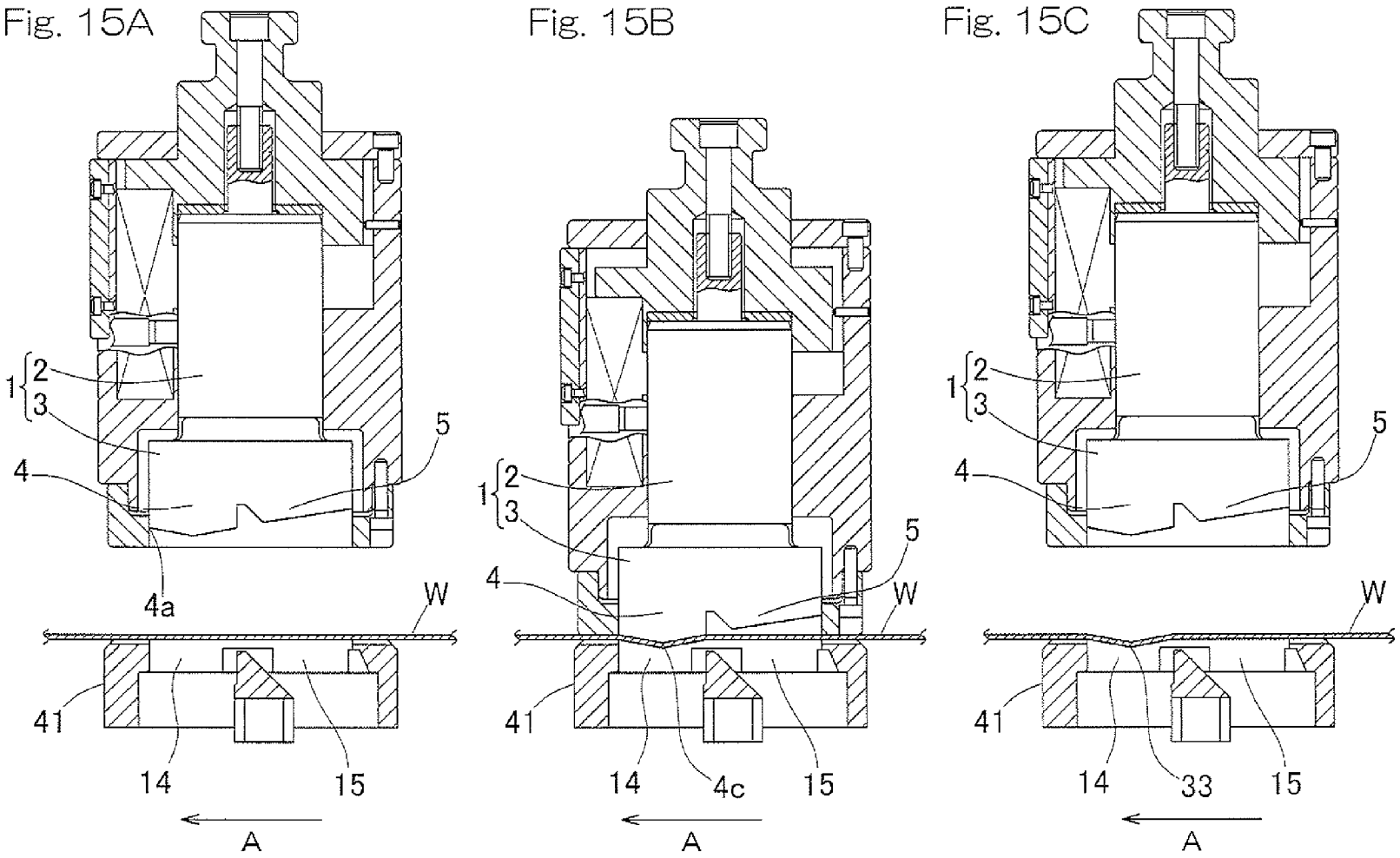
FIGS. 15A to 15C are sectional views of the die mounting portion, showing the first punch processing operation during the starting end notching step.

As shown in FIGS. 15A to 15C, the starting end notching step is carried out by positioning the nibbler assembly so that the position of the punching edge 4*a* on the downstream side of the first blade section 4 of the punch 1 may be aligned with a starting end of the elongated hole 51 (best shown in FIG. 14E), that is to be formed in the sheet material W, or so that such a position may assume an upstream side of the starting end, followed by down-striking the punch 1 for the nibbler assembly. The height of the punch 1, when at the most descended position (as shown in FIG. 15B), is chosen so that only the notching and punching edge 4*c* of the first blade section 4 may assume a heightwise level not exceeding an upper surface of the sheet material W. By so doing, a location of the sheet material W, which is positioned below the notching and punching edge 4*c* of the first blade section 4, is lowered by the first blade section 4 to form a depressed piece 33 including a notch 32 (as shown in FIG. 14B) in a direction parallel or substantially parallel to the feed direction A. The depressed piece 33 so formed is deformed most downwardly at an intermediate portion thereof with respect to the feed direction A, but is still connected with a main body portion of the sheet material W at opposite ends thereof with respect to the feed direction A. As is the case with the method of forming the elongated hole in the sheet material according to the previously described preferred embodiment of the present invention, no processed hardening occurs in the sheet material W at the opposite ends of the notch 32 and no roll-over occurs substantially in the punched surface and the cut surface.

Figures 16A, 16B, 16C:
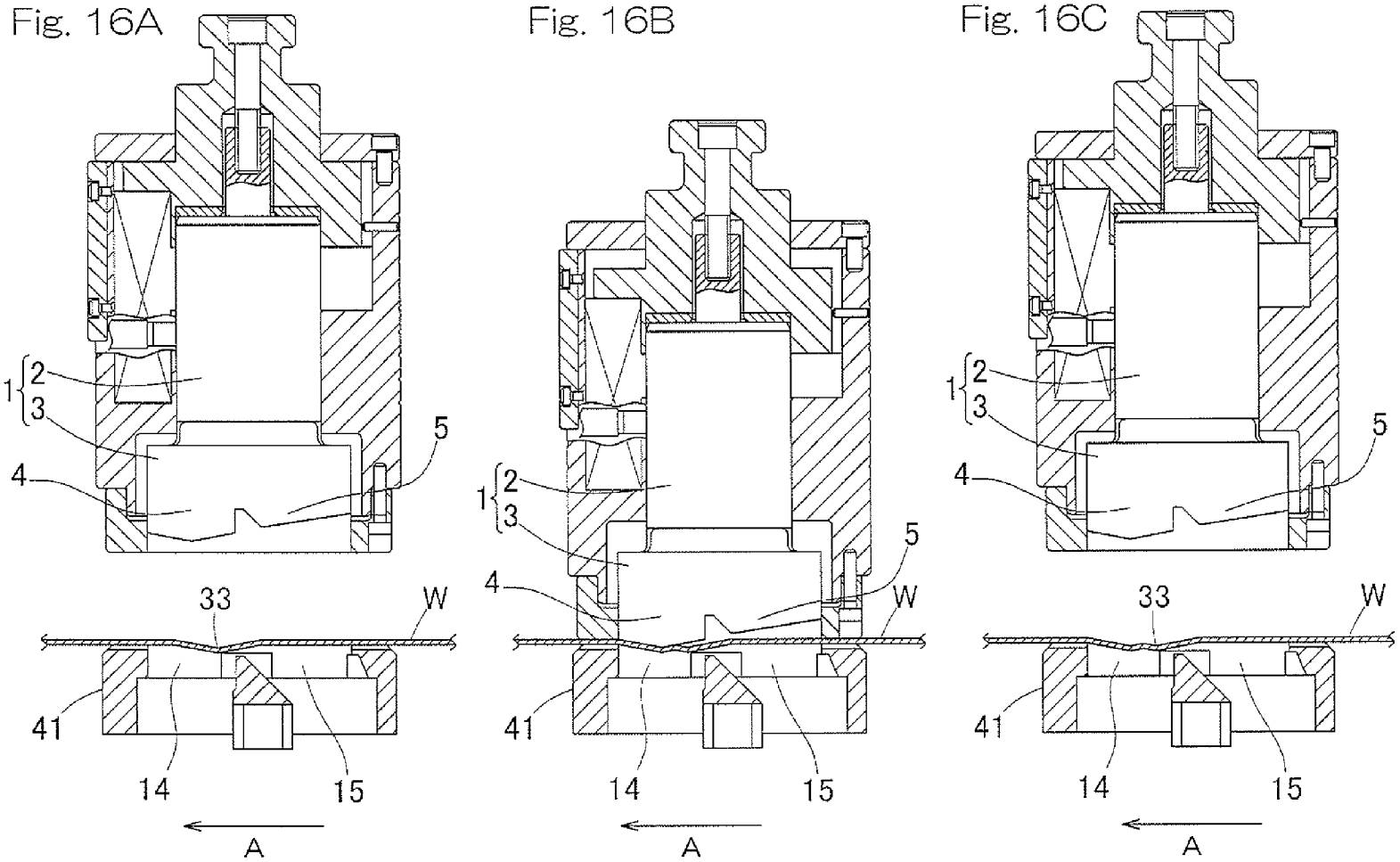
FIGS. 16A to 16C are sectional views of the die mounting portion, showing the second punch processing operation during the starting end notching step.

Thereafter, as shown in FIGS. 16A to 16C, while the sheet material W is displaced by a distance towards the upstream side (rightwards as viewed in the figure) with respect to the feed direction A, specifically the nibbler assembly is relatively displaced by a distance relative to the sheet material W towards the downstream side with respect to the feed direction A, the processing of the starting end notching step similar to that described above is carried out to increase the length of the depressed piece 33 in a direction parallel or substantially parallel to the feed direction A. This is for the purpose that during the subsequent starting end punching step, the notch 32 following a punched hole 34 can be formed. The processing of the starting end notching step is performed a number of times before the notch 32 of a proper length is obtained.

Figures 17A, 17B, 17C:
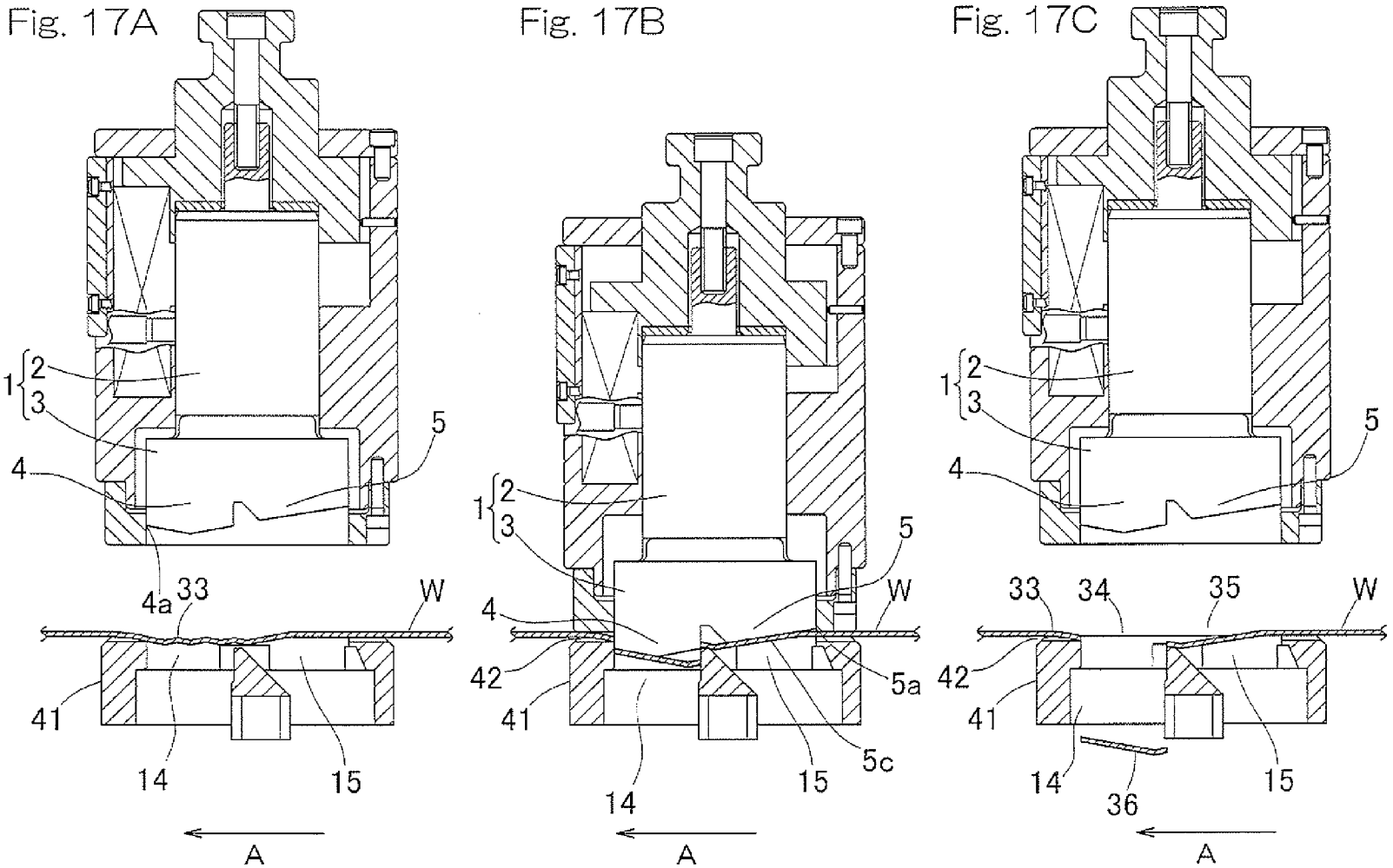
FIGS. 17A to 17C are sectional views of the die mounting portion, showing the punch processing operation during the starting end punching step.

As shown in FIGS. 17A to 17C, the starting end punching step is carried out by positioning the nibbler assembly so that the punching edge 4*a* on the downstream side of the first blade section of the punch 1 may assume a position above the depressed piece 33 and then by descending the punch 1 of the nibbler assembly. The height of the punch 1, when at the most descended position (shown in FIG. 17B), is chosen so that the whole or a portion of the notching and punching edge 5*c* of the second blade section 5 may assume a heightwise level not exceeding the upper surface of the sheet material W, but the punching edge 5*a* of the second blade section 5 may assume a heightwise level exceeding the upper surface of the sheet material W. By so choosing, a portion of the depressed piece 33, which is upstream of the feed direction A, and a sheet material portion on an upstream side with respect to the feed direction A are punched by the first blade section 4 to form a punched hole 34, with the remaining portion of the depressed piece 33 left on the downstream side cutout 42 of the die 41.

Also, the notch 32 (best shown in FIG. 14C) is formed by the second blade section 5, which notch 32 extends from the punched hole 34 towards the upstream side with respect to the feed direction A, with an inner side portion of the notch 32 being downwardly depressed to leave a tongue-shaped notched piece 35. A punched piece 36, which has been punched, falls downwards through the first throughhole 14 of the die 41. The notched piece 35 has its base end continued with the main body portion of the sheet material W.

As described previously, since no processed hardening occurs in the sheet material W in the vicinity of the opposite ends of the notch 32 which has been formed by the first blade section 4 during the previously described starting end notching step, even though during the starting end notching step the depressed piece 33 is punched by the first blade section 4, no seam, which tends to occur in an overlap area between the notch 32 of the depressed piece 33 and the punched hole 34 when punched holes are continuously and individually formed, is left therein. As is the case with the depressed piece 33, the sheet material W does not undergo the processed hardening in the vicinity of the base end of the notch 32 and no roll-over occurs substantially in a punched surface nor in the cut surface either.

Figures 18A, 18B, 18C:
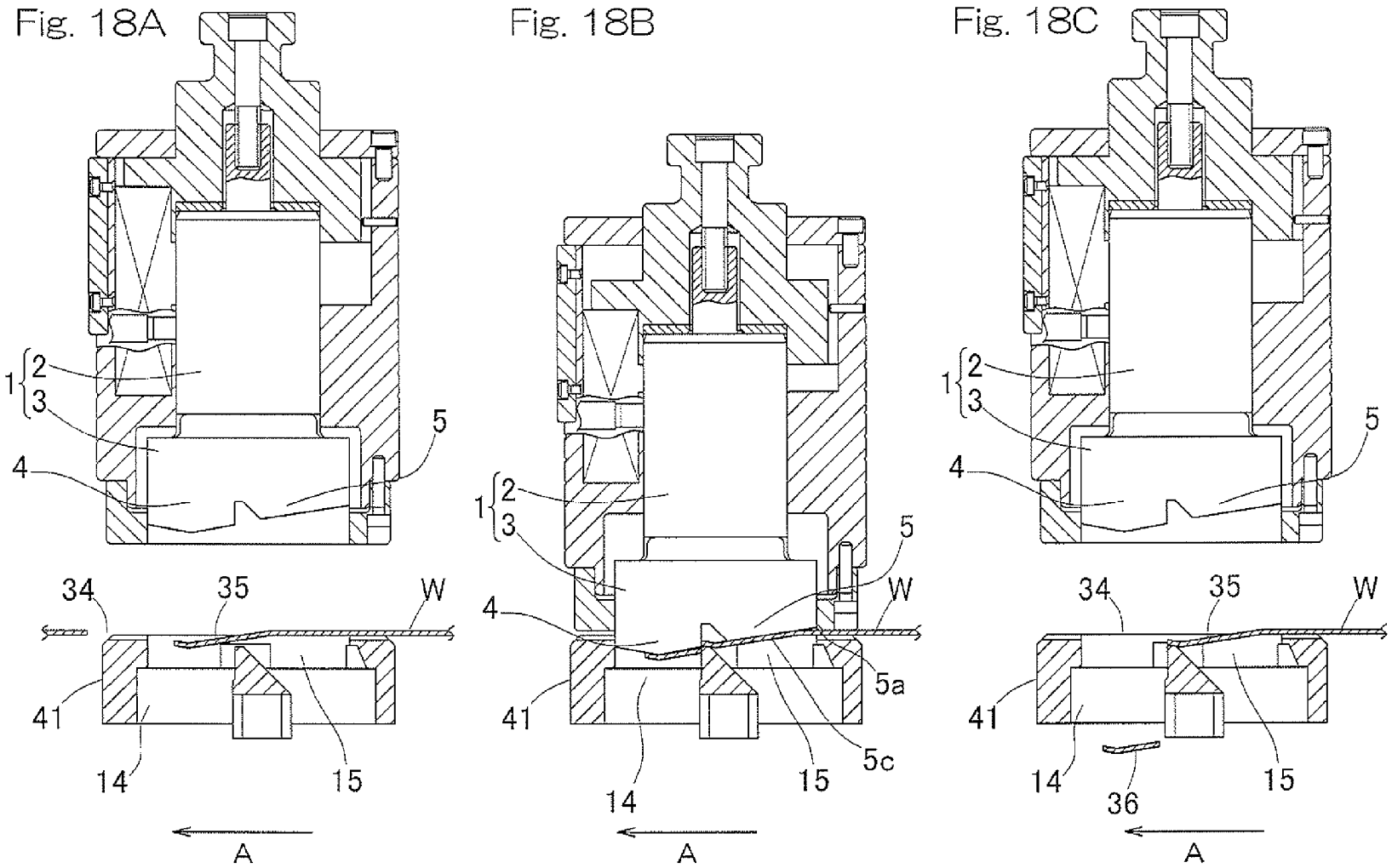
FIGS. 18A to 18C are sectional views of the die mounting portion, showing the punch processing operation during the nibbling step.

The nibbling step is carried out a number of times while the nibbler assembly is moved along an inner edge of the window opening 50. As shown in FIGS. 18A to 18C, the nibbling step is carried out by positioning the nibbler assembly so that the notched piece 35, formed during the starting end punching step or the previous nibbling step, may be positioned so as to straddle between the first blade section 4 and the second blade section 5, followed by down-striking of the punch 1 of the nibbler assembly. The height of the punch 1, when at the most descended position (as shown in FIG. 18B), is chosen so that the whole or a portion of the notching and punching edge 5*c* of the second blade section 5 may assume a heightwise level not exceeding the upper surface of the sheet material W, but the punching edge 5*a* of the second blade section 5 may assume a heightwise level exceeding the upper surface of the sheet material W. By so choosing, a sheet material portion including the notched piece 35 is punched by the first blade section 4 to form a punched hole 34, and a new notch 32 is subsequently formed by the second blade section 5, which notch 32 extends from the punched hole 34 towards the upstream side with respect to the feed direction A, with an inner side portion of such notch 32 being downwardly depressed to leave a new notched piece 35.

As described previously, since no processed hardening occurs in the sheet material W in the vicinity of the base end of the notch 32 of the notched piece 35, no seam or substantially no seam, which tends to occur in an overlap area between the notch 32 of the notched piece 35 and the punched hole 34, is left therein.

Figure 14D:
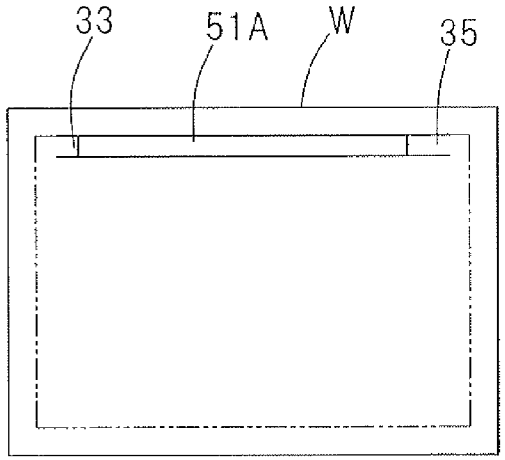
Figure 14F:
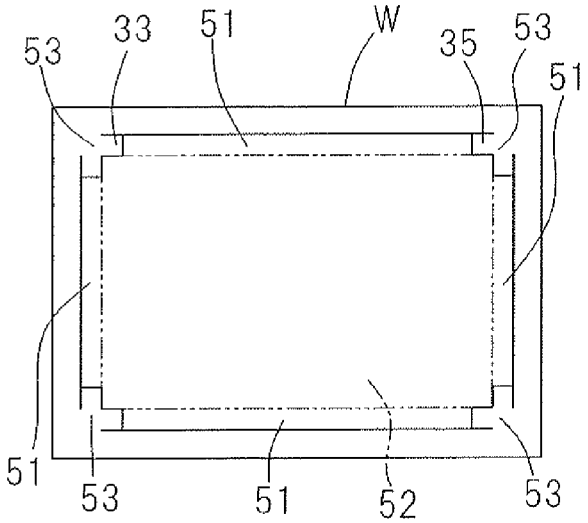
Figures 19A, 19B, 19C:
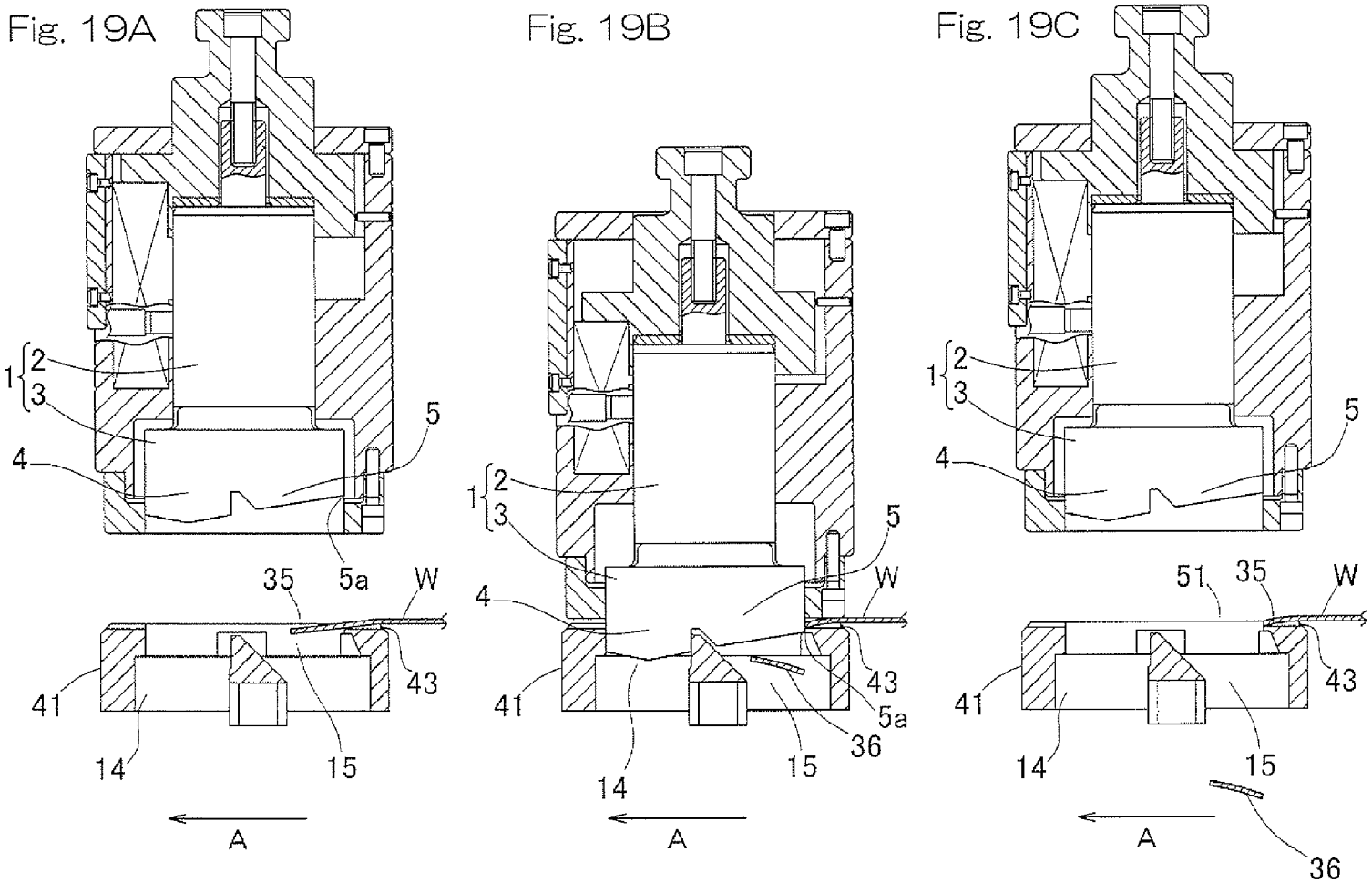
FIGS. 19A to 19C are sectional views of the die mounting portion, showing the punch processing operation during the terminal end punching step.
Figure 20A:
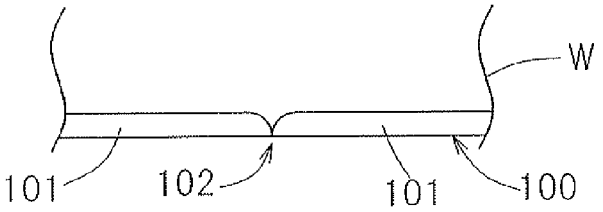
FIG. 20A is a top plan view showing a cut portion in the sheet material, which is formed by the conventional nibbling technique.
Figure 20B:
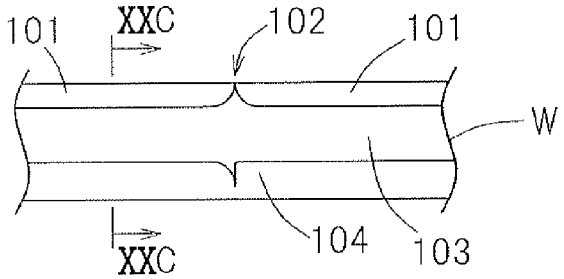
PRIOR ART Fig. 20B
FIG. 20B is a front elevational view of the cut portion.
Figure 20C:
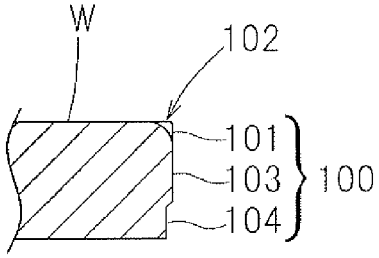
PRIOR ART Fig. 20C
FIG. 20C is across sectional view taken along the line XXC-XXC in FIG. 20B.

An elongated hole 51A is formed by the punched holes 34 then overlapping one after another, which holes 34 are formed during the starting end punching step and each of the nibbling steps, and when a tip end of the elongated hole 51A reaches a position immediately preceding a terminating end of an intended elongated hole 51 (as shown in FIG. 14D), a processing of the terminating end punching step is carried out. The terminating end punching step is as shown in FIGS. 19A to 19C, in which the nibbler assembly is positioned so as to allow the punching edge 5*a* of the second blade section 5 of the punch 1 to assume a position immediately above the notched piece 35, which has been formed during the final cycle of the nibbling steps, and then, the punch 1 of the nibbler assembly is stricken downwardly. The height of the punch 1, when at the most descended position (as shown in FIG. 19B), is chosen so as to allow the punching edge 5*a* of the second blade section 5 to assume a heightwise level not exceeding the lower surface of the sheet material W. By so choosing, a portion of the notched piece 35 on the downstream side with respect to the feed direction A, which notched piece 35 is formed during the final cycle of the nibbling steps, is punched and the intended elongated hole 51 is thus formed (as shown in FIG. 14E). A punched piece 36 is allowed to fall downwards through the second throughhole 15 defined in the die 11. The remaining portion of the notched piece 35, which have been left without being punched, remains above the upstream side notch 43 of the die 41.

When the elongated holes 51 are formed each along one of the sides of the window opening 50 in a manner similar to that described hereinbefore, those elongated holes 51 are connected together and a sheet material portion 52, positioned inside each of the elongated holes 51, is removed (as shown in FIG. 14F). At this stage, an angled remaining piece 53 remains at a corner portion of the window opening 50. Opposite end portions of this remaining piece 53 include that remaining portion of the depressed piece 33, left during the starting end punching step, and that remaining portion of the notched piece 35 left during the terminating end punching step. If the remaining piece 53 is punched by a separate set of punch and die (not shown), the window opening 50 completes. Since the opposite end portions of the remaining piece 53 includes the depressed piece 33 and the notched piece 35 both having the notches 52, no seam is left at ends of overlapping portions of the remaining pieces 53 where punching has been effected.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A punch for a punching press capable of performing a nibbling operation on a sheet material while the sheet material is fed in a feed direction, the punch comprising:

a first blade section and a second blade section juxtaposed relative to each other on a punch lower surface in a direction parallel or substantially parallel to the feed direction of the sheet material;

an upstream side end surface and a downstream side end surface that each include a plane surface perpendicular to the feed direction; and a pair of side surfaces that each include a plane surface extending in the feed direction and the vertical direction; wherein a recess is defined between the first blade section and the second blade section at the punch lower surface, the first blade section being located on a downstream side of the recess with respect to the feed direction and the second blade section being located on an upstream side of the recess with respect to the feed direction;

the first blade section extends downwardly of the second blade section, and includes a first bottom surface including a downstream end edge, an upstream end edge, and a pair of first side edges;

the first bottom surface has a protruding shape which extends at an incline downwardly from the upstream end edge in the feed direction to a lowest end of the punch, and further extends such that the protruding shape is inclined upwardly from the lowest end to the downstream end edge in the feed direction;

the upstream end edge and the downstream end edge define a punching edge, and the pair of first side edges define a notching and punching edge;

the second blade section includes a second bottom surface including an upstream end edge, a downstream end edge, and a pair of second side edges;

the second bottom surface has an inclined shape which extends at an incline downwardly from the upstream end edge to the downstream end edge in the feed direction; and the upstream end edge defines a punching edge, and the pair of second side edges defines a notching and punching edge.

2. A nibbler assembly for a punching press comprising:

the punch according to claim 1; and a die; wherein the die is partitioned by a partition wall into downstream and upstream sides with respect to the feed direction of the sheet material and includes first and second throughholes defined on the downstream and upstream sides, respectively, the first and second blade sections of the punch being arranged to enter the first and second throughholes, respectively;

the first throughhole includes inner wall surfaces including wall surface portions on the downstream and upstream sides with respect to the feed direction of the sheet material that define die side punching edges engageable with the punching edge of the first blade section on the downstream and upstream sides of the first blade section and an upper end edge of a wall surface portion following the feed direction of the sheet material defining a die side notching and punching edge engageable with the notching and punching edge of the first blade section; and the second throughhole includes inner wall surfaces, an upper end edge of a wall surface portion on the upstream side with respect to the feed direction of the sheet material defining a die side punching edge engageable with the punching edge of the second blade section and an upper end edge of a wall surface portion parallel or substantially parallel to the feed direction of the sheet material defining a die side notching and punching edge engageable with the notching and punching edge of the second blade section.

3. The nibbler assembly for the punching press as claimed in claim 2, wherein in the first throughhole, the wall surface portion defining the die side punching edge engageable with the punching edge on the downstream side includes an upper end edge lower than the wall surface portion defining the die side notching and punching edge engageable with the notching and punching edge, and a downstream side cutout, which includes an upper surface of a height lower than any other section of the wall surface portion defining the die side punching edge, is defined by the wall surface portion, including such a low upper end edge thereof, towards the downstream side; and in the second throughhole, the wall surface portion defining the die side punching edge engageable with the punching edge includes an upper end edge lower than the wall surface portion defining the die side notching and punching edge engageable with the notching and punching edge and an upstream side cutout, which includes an upper surface of a height lower than any other section of the wall surface portion defining the die side punching edge, is defined by the wall surface portion, including such a low upper end edge thereof, towards the upstream side.

* * * * *